US010022582B2

(12) United States Patent
Gangemi et al.

(10) Patent No.: US 10,022,582 B2
(45) Date of Patent: Jul. 17, 2018

(54) BARBELL COLLAR AND BARBELL SYSTEM

(71) Applicant: VENICE GRAVITY WORX, INC., Venice, CA (US)

(72) Inventors: Carmine Gangemi, Venice, CA (US); Alberto Bevacqua, Venice, CA (US)

(73) Assignee: Venice Gravity Worx, Inc., Venice, CA (US)

( * ) Notice: Subject to any disclaimer, the term of this patent is extended or adjusted under 35 U.S.C. 154(b) by 0 days.

(21) Appl. No.: 14/760,333

(22) PCT Filed: Aug. 6, 2014

(86) PCT No.: PCT/US2014/050003

§ 371 (c)(1),
(2) Date: Jul. 10, 2015

(87) PCT Pub. No.: WO2016/022115

PCT Pub. Date: Feb. 11, 2016

(65) Prior Publication Data

US 2017/0144011 A1 May 25, 2017

(51) Int. Cl.

| | |
|---|---|
| ***A63B 21/00*** | (2006.01) |
| ***A63B 21/055*** | (2006.01) |
| ***A63B 21/072*** | (2006.01) |
| ***A63B 21/075*** | (2006.01) |
| ***A63B 23/00*** | (2006.01) |

(Continued)

(52) U.S. Cl.

CPC .... *A63B 21/0728* (2013.01); *A63B 21/00061* (2013.01); *A63B 21/00065* (2013.01); *A63B 21/00069* (2013.01); *A63B 21/0552* (2013.01); *A63B 21/075* (2013.01); *A63B 21/0724* (2013.01); *A63B 21/4043* (2015.10); *A63B 23/0405* (2013.01); *A63B 23/1209* (2013.01); *A63B 23/1218* (2013.01);

(Continued)

(58) Field of Classification Search

CPC ..... A63B 21/00; A63B 21/072–21/075; A63B 21/4043

USPC ..... 108/108, 109, 141, 49; D21/681–682

See application file for complete search history.

(56) References Cited

U.S. PATENT DOCUMENTS

| | | | |
|---|---|---|---|
| 3,468,534 | A | 9/1969 | Donato |
| 3,756,597 | A | 9/1973 | Monti |

(Continued)

FOREIGN PATENT DOCUMENTS

| | | |
|---|---|---|
| WO | 2013019226 | 2/2013 |

OTHER PUBLICATIONS

International Search Report for PCT/US2014/050003, dated Apr. 14, 2015.

*Primary Examiner* — Loan H Thanh
*Assistant Examiner* — Jennifer M Deichl
(74) *Attorney, Agent, or Firm* — Hankin Patent Law, A.P.C.; Kevin Schraven; Anooj Patel

(57) ABSTRACT

A barbell collar. The barbell collar may comprise: a plate; and at least two weight bars. The plate may comprise a hole and at least two arm portions. The hole may be configured to substantially engage with an end portion of a barbell. Each of the at least two weight bars may be attached to each of the at least two arm portions of the plate. The at least two weight bars may be adapted to engage and hold one or more disc weights, such that when the barbell collar is attached to the barbell, the additional disc weights may provide additional varying resistances.

15 Claims, 44 Drawing Sheets

(51) Int. Cl.
*A63B 23/04* (2006.01)
*A63B 23/12* (2006.01)

(52) U.S. Cl.
CPC .... *A63B 23/1245* (2013.01); *A63B 2023/006* (2013.01); *A63B 2023/0411* (2013.01)

(56) References Cited

U.S. PATENT DOCUMENTS 3,904,198 A 9/1975 Jones
4,231,569 A 11/1980 Rae
D261,788 S 11/1981 Burns
4,647,038 A 3/1987 Noffsinger
4,867,444 A 9/1989 Castillo
D306,332 S 2/1990 Mayfield
5,029,849 A 7/1991 Nurkowski
5,152,731 A 10/1992 Troutman
5,344,375 A 9/1994 Cooper
6,022,300 A 2/2000 Hightower
D433,468 S 11/2000 Rojas et al.
D437,015 S 1/2001 Rojas et al.
6,663,542 B1 12/2003 Trabbic
7,056,268 B2 6/2006 Emick
7,201,711 B2 * 4/2007 Towley, III ..... A63B 21/0605 482/106
D583,883 S 12/2008 Thomas
7,780,575 B1 * 8/2010 Goodwin, III ..... A63B 1/00 482/34
7,789,814 B1 9/2010 Xu
D644,073 S 8/2011 Nottke
8,047,975 B1 * 11/2011 Chen ..... A63B 21/072 482/104
D657,010 S 4/2012 Cen
D685,865 S 7/2013 Kuhn
D686,286 S 7/2013 Orakwusi
8,500,609 B1 8/2013 Williams
2006/0014615 A1 * 1/2006 Godbold ..... A63B 21/00047 482/141
2006/0105890 A1 5/2006 Logue
2006/0276314 A1 12/2006 Wilson et al.
2008/0220951 A1 9/2008 Webber
2012/0094810 A1 4/2012 Anderson
2012/0208681 A1 8/2012 Anderson
2013/0035218 A1 2/2013 Wierszewski
2013/0260970 A1 * 10/2013 Moskowich ..... A63B 21/068 482/141
2014/0018214 A1 1/2014 Jordan
2014/0045660 A1 2/2014 Murray et al.
2014/0094347 A1 4/2014 Orakwusi
2014/0162850 A1 6/2014 Chen
2014/0187392 A1 7/2014 Renk
2014/0200119 A1 7/2014 Sides

* cited by examiner

BARBELL COLLAR AND BARBELL SYSTEM

CROSS-REFERENCE TO RELATED APPLICATIONS

This Application is a U.S. National Stage Utility Non-Provisional Patent Application to PCT Application No. PCT/US2014/050003, filed on Aug. 6, 2014, by co-inventors Carmine Gangemi and Alberto Bevacqua, the contents of which are hereby expressly incorporated by this reference in their entirety, and to which priority is claimed.

FIELD OF USE

The present disclosure relates generally to exercise equipment. More specifically, the present disclosure relates to barbell attachment devices that provide various weight resistances on a barbell, relative to the horizontal plane of the barbell.

BACKGROUND

Weightlifting is a common type of activity for the development of strength and size of skeletal muscles. Weightlifting generally utilizes the weight force of gravity (in the form of weighted bars, and/or weighted disc plates) to oppose the force generated by muscle through concentric or eccentric contractions. Thus, the use of free weights such as a barbell with disc-weights helps increase the strength and tone of muscles in the arms, upper body, and lower body of the user through various exercises.

Although barbells allow a weightlifter to accommodate a significant amount of weight due to the two handed control and balance, barbells may not be best suited for certain exercises. Specifically, when using a barbell, a user may be unable to properly isolate specific muscle groups during weight lifting exercises. Users may also be unable to perform exercises that are directed to adjusting the resistance relative to the center gravity of a barbell.

In particular, barbells generally have only have two basic positions in which a user's arms may be positioned (i.e., palms up and palms down). While these positions may be adjusted to some degree (by repositioning the user's palms along the horizontal bar) to isolate certain muscle groups or vary particular exercises, every other possible position and variation of the user's arms is usually restrained by the fact that the bar is generally straight and unitary.

To overcome this problem of limited variations and use, different types of special barbells have been created. For example, a curling barbell having V-shaped grip portions along its length has been created, so that the user may hold the bar with his or her wrists positioned inwards or outwards at an angle to isolate specific muscle groups in the arm or minimize discomfort when performing a curl exercise. An extension bar which generally has two handles disposed perpendicular to the length of the barbell has also been created, so that the user's palms can face inwards or towards each other, thereby better isolating the triceps.

Despite the advantages of the above-mentioned reconfigured barbells, these barbells do not completely address the issue of varying the resistance in relation to the center of gravity or horizontal plane of the barbell. Rather, the above-mentioned barbells are only directed to isolating particular muscle groups by repositioning the user's hands and arms with respect to the barbell.

Thus, what is needed is device that varies the sense of resistance of a barbell with respect to the center of gravity and/or horizontal plane of the barbell. Preferably, the device may be attached to a standard barbell or barbell-like devices and may be used to provide the user with resistance relative the horizontal plane of the barbell as well as the manner in which the task is performed. Furthermore, versatility in the manner of attachment may also be beneficial.

SUMMARY

To minimize the limitations in the prior art, and to minimize other limitations that will become apparent upon reading and understanding the present specification, the following discloses a barbell collar that provides various weight resistances in relation to the center of gravity of a barbell.

One embodiment may be a barbell collar, comprising: a plate; and at least two weight bars; wherein the plate comprises a hole and at least two arm portions; wherein the hole is configured to engage with a barbell; and wherein each of the at least two weight bars is attached to each of the at least two arm portions of the plate. The at least two weight bars may be adapted to engage and hold one or more weights. The at least two arm portions may comprise: a first arm portion and a second arm portion; wherein the hole may be located approximately near a first end of the first arm portion; wherein the at least two weight bars may comprise a first weight bar and a second weight bar; wherein the second weight bar may be located approximately near a second end of the first arm portion and approximately near a first end of said second arm portion; and wherein the first weight bar may be located approximately near a second end of the second arm portion. The at least two arm portions may comprise: a first arm portion; and a second arm portion; wherein the first arm portion may be longer than the second arm portion. The first arm portion may be aligned, but not limited to, between approximately 130 to 140 degrees from the second arm portion. Each of the at least two weight bars may be positioned approximately near an end of each of the at least two arm portions of the plate. The at least two weight bars may be substantially perpendicular to the at least two arm portions of the plate. The barbell collar may further comprise an axle bearing; wherein the axle bearing may be positioned in and substantially aligned with the hole of the plate; and wherein the axle bearing may be configured to engage with the barbell. The axle bearing may be configured to lock on to the barbell, such that the barbell collar may not rotate around the barbell. The axle bearing may be configured to releasably lock on to the barbell.

Another embodiment may be a barbell system, comprising: a barbell; a first barbell collar; and a second barbell collar; wherein the first barbell collar comprises: a first plate and two first weight bars; wherein the first plate comprises a first hole and two first arm portions; wherein the first hole of the first barbell collar is configured to substantially engage with a first end of the barbell; wherein each of the two first weight bars is attached to each of the two first arm portions of the first plate; wherein the second barbell collar comprises: a second plate and two second weight bars; wherein the second plate comprises a second hole and two second arm portions; wherein the second hole of the second barbell collar is configured to substantially engage with a second end of the barbell; wherein each of the two second weight bars is attached to each of the two second arm portions of the second plate; and wherein the two first weight bars and the two second weight bars are adapted to engage and hold the one or more weights. The two first arm portions of the first plate may comprise: a first arm portion and a second arm portion; wherein the first hole may be located approximately near a first end of the first arm portion; wherein the two first weight bars may comprise a first weight bar and a second weight bar; wherein the second weight bar may be located approximately near a second end of the first arm portion and approximately near a first end of the second arm portion; wherein the first weight bar may be located approximately near a second end of the second arm portion; wherein the two second arm portions of the second plate may comprise: a third arm portion and a fourth arm portion; wherein the second hole may be located approximately near a first end of the third arm portion; wherein the two second weight bars may comprise a third weight bar and a fourth weight bar; wherein the fourth weight bar may be located approximately near a second end of the third arm portion and approximately near a first end of the fourth arm portion; and wherein the third weight bar may be located approximately near a second end of the fourth arm portion. The two first arm portions of the first plate may comprise: a first arm portion and a second arm portion; wherein the two second arm portions of the second plate may comprise: a third arm portion and a fourth arm portion; wherein the first arm portion may be longer than the second arm portion; and wherein the third arm portion may be longer than the fourth arm portion. The first arm portion may be aligned between approximately 130 to 140 degrees from the second arm portion; and the third arm portion may be aligned between approximately 130 to 140 degrees from the fourth arm portion. Each of the two first weight bars may be positioned approximately near an end of each of the two first arm portions of the first plate; and each of the two second weight bars may be positioned approximately near an end of each of the two second arm portions of the second plate. The two first weight bars may be substantially perpendicular to the two first arm portions of the first plate; and wherein the two second weight bars may be substantially perpendicular to the two second arm portions of the second plate. The barbell system may further comprise a first axle bearing and a second axle bearing; wherein the first axle bearing may be positioned and substantially aligned with the first hole of the first plate; wherein the second axle bearing may be positioned and substantially aligned with the second hole of the second plate; wherein the first axle bearing may be configured to substantially engage with the first end of the barbell; and wherein the second axle bearing may be configured to substantially engage with the second end of the barbell. The first axle bearing may be configured to lock on to the barbell, such that the first barbell collar may not rotate around the barbell; and wherein the second axle bearing may be configured to lock on to the barbell, such that the second barbell collar may not rotate around the barbell. The first axle bearing and the second axle bearing may be configured to releasably lock on to the barbell.

Another embodiment may be a barbell collar, comprising: a plate; a first weight bar; a second weight bar; and an axle bearing; wherein the plate comprises: a hole, a first arm portion, and a second arm portion; wherein the axle bearing is positioned and substantially aligned within the hole of the plate; wherein the axle bearing is configured to substantially engage with an end of a barbell; wherein the first arm portion is longer than the second arm portion; wherein the first arm portion is aligned between approximately 130 to 140 degrees from the second arm portion; wherein the first weight bar and the second weight bar are substantially tubular; wherein the first weight bar is attached to the first arm portion of the plate and is positioned approximately near an end of the first arm portion of the plate; wherein the second weight bar is attached to the second arm portion of the plate and is positioned approximately near an end of the second arm portion of the plate; wherein the first weight bar is substantially perpendicular to the first arm portion of the plate; wherein the second weight bar is substantially perpendicular to the second arm portion of the plate; and wherein the first weight bar and the second weight bar are adapted to engage and hold one or more disc weights. The axle bearing may be configured to lock on to the barbell, such that the barbell collar does not rotate around the barbell.

Beyond the utilization of disc weights or weight plates as a form of resistance, various embodiments of the barbell collar are also compatible with other forms of applied resistance coupled to it such as elastic exercise bands. Thus, the elastic exercise bands may also influence the relative motion of the barbell collars and weight resistance along the horizontal plane too.

It is an object to provide a barbell collar that may be used in pairs to accommodate a wide variety of barbells, including the standard barbell (i.e., with 1 inch axle bearings) and/or Olympic style barbell (i.e., with 2 inch axle bearings).

It is an object to provide a barbell collar that takes advantages cam configurations, but may function differently from a cam. Specifically, a cam, which is generally any device that rotates and is used to transform rotary motion into linear motion, may function differently from the barbell collar because the barbell collar may be configured to possibly neutralize any rotational movement.

It is an object to provide a barbell collar that may influence both the ratio of skeletal muscle involvement in a given exercise and that may influence the ratio of specific skeletal muscles that are involved in a particular exercise. This may be due to the position of the resistance relative the horizontal plane of the barbell as well as the manner in which the task is performed. Thus, in some movements such as performing simultaneous knee and hip extensions (e.g., rising from a chair or squat exercises), the barbell collar may affect the reaction of hamstrings and rectus femoris as well as the ratio of the hamstring to the rectus femoris.

It is an object to provide a barbell collar that may force the user to maintain lifting control to avoid torque overshoot. Torque spikes or torque overshoots generally occur when the person's limbs accelerates past the desired speed. Specifically, when overcoming resistance in strength training activities, the load range of the resistance may become increasingly smaller as velocity is increased. This may result with a torque spike or torque overshoot caused by the preceding velocity overshoot. Thus, the barbell collar may be configured to help minimize or prevent torque overshoot to help increase or stabilize force generation by the muscles preforming the exercise.

It is an object to provide a barbell collar that prevents a user from "bouncing off" a tendon that is stretched when overcoming resistance. When lifting or moving a barbell, wherein a user is using a barbell without the barbell collar, the user may "bounce off" and/or overstretch a tendon to overcome some form of resistance. This may occur due to the tendons shortening and/or lengthening at certain velocities, which may create an elastic response to conserve energy. The barbell collar, however, may be configured to prevent the user from "bouncing off" a tendon when overcoming the resistance. This may help the user to depend upon the contracting muscle fiber more than the tendon to influence the position of the resistance, which makes the exercise much more efficient and effective.

It is another object to provide a barbell collar that can be used in various exercises, including without limitation: barbell or bicep curls, double arm shoulder raises, straight or bent knee quad lifts, inner thighs version of straight or bent knee quad lifts, hamstring and gluteus straight or bent knee quad lifts, squats, deadlifts, military presses, barbell rows, and the like.

It is an object of the new apparatus to avoid the limitations of the prior art.

Other features and advantages that are inherent in the barbell collar claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE ILLUSTRATIVE EMBODIMENTS

Figure 1:
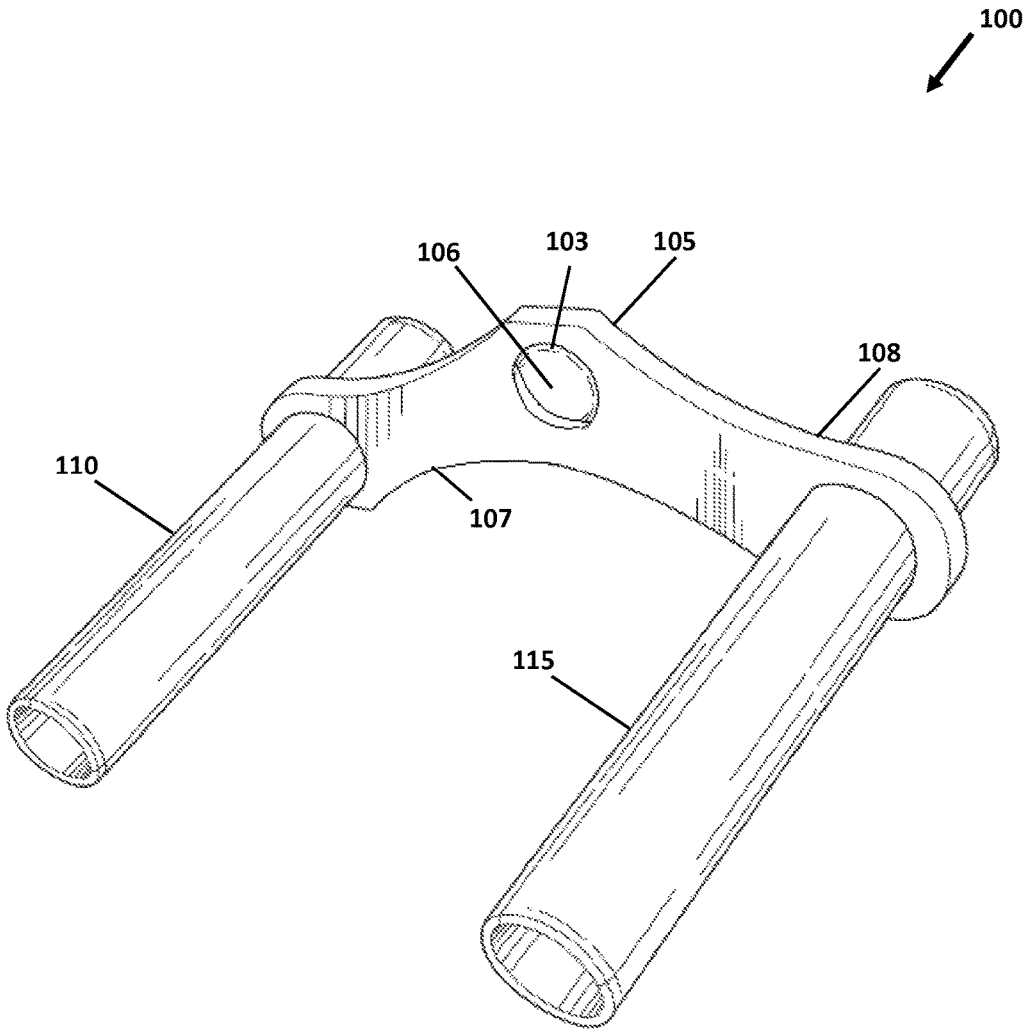
FIG. 1 is an illustration of a top perspective view of one embodiment of a barbell collar.

In the following detailed description, numerous specific details are set forth in order to provide a thorough understanding of various aspects of one or more embodiments of the disclosure. However, the one or more embodiments may be practiced without some or all of these specific details. In other instances, well-known methods, procedures, and/or components have not been described in detail so as not to unnecessarily obscure aspects of embodiments.

While multiple embodiments are disclosed, other embodiments may become apparent to those skilled in the art from the following detailed description. As will be realized, the following is capable of modifications in various obvious aspects, all without departing from the spirit and scope of the disclosure. Accordingly, the graphs, figures, and the detailed descriptions thereof, are to be regarded as illustrative in nature and not restrictive. Also, the reference or non-reference to a particular embodiment shall not be interpreted to limit the scope of protection Before the following is disclosed and described, it is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

In the following description, certain terminology is used to describe certain features of one or more embodiments. For example, the term "barbell" generally refers to any long and strong metal bar to which disks of varying weights may be attached at each end, and may be used for weightlifting. Examples of barbells may include, without limitation, standard barbells, curl bars, EZ curl bars, fixed barbells, thick-handled barbells, triceps bars, trap bars, Olympic style barbells with a 2-inch axle bearing, and/or standard barbells with a 1-inch axle bearing.

The present specification discloses a new and improved barbell collar, which may be one or more devices configured to be attached to a barbell. Specifically, the barbell collar may be generally configured to attach to the end portions of an existing barbell and may be used in pairs with respect to a single barbell. Each barbell collar may comprise at least two arm portions, wherein each arm portion may comprise a weight bar. Each weight bar may be tubular and may be configured to hold and secure one or more disc weights. In a preferred embodiment, one arm portion may be longer than the other arm portion and may be angled in approximately 135° degrees from each other. The barbell collar may also be configured to rotate 360° degree around the barbell and releasable lock in various positions around the barbell.

The barbell collar may be used in several ways. The barbell collar may be utilized with only one of the arm portions loaded with disc weights. The barbell collar may be also used with the both of the arm portions loaded with disc weights. In various exercises, the amount of disc weights added to the arm portions may change. Adding and subtracting weights to the arm portions may affect the position of the barbell collar(s) as the exercise is being performed. Additionally, the user may influence the position of the arm portions in a manner, in which the user moves the actual barbell. For example, gravity may pull one arm portion down, potentially, keeping that arm portion at an approximately 90° degrees with respect to the ground's surface. However, the user may also influence the movement of the barbell by causing the barbell collar to move in an arc through various angles of free movement. The amount of weight or resistance applied to one arm portion may also influence the position of the other arm portion. Finally, the barbell collar may be used in a manner that promotes a more controlled movement of the barbell in that the user may attempt to minimize the movement of the arms through a controlled and deliberate manner of the actual barbell movement.

FIG. 1 is an illustration of a top perspective view of one embodiment of a barbell collar. As shown in FIG. 1, one embodiment of the barbell collar 100 may comprise: an axle-bearing 103; plate 105, first weight bar 110, and second weight bar 115, wherein the plate 105 may comprise: a hole 106, first arm portion 107, and second arm portion 108. The plate 105 is generally constructed of any rigid material, such as metal (e.g., steel and iron), but may be constructed of any type of material, including plastics, composites, and other man made materials. Because the barbell collar 100 is generally used in weight-lifting, it may be made of a heavy and strong metal, such as steel and/or iron. The first weight bar 110 and second weight bar 115 may be solid, or substantially tubular, as shown, and are generally configured to receive and hold various weights, such as barbell disc weights, which are not shown, but well known in the art. As shown, the first weight bar 110 and second weight bar 115 may be located approximately near the ends of first arm portion 107 and the second arm portion 108, respectively, and may be substantially perpendicular to the first arm portion 107 and second arm portion 108.

Regarding the plate 105, the plate 105 may comprise: a hole 106, first arm portion 107, and second arm portion 108. The hole 106 may be configured to engage and secure onto a barbell, typically an end portion of a barbell. The hole 106 may also include an axle-bearing 103, which may be configured to releasably lock the barbell collar 100 into a particular position with respect to the barbell, or allow the barbell to freely rotate. The first arm portion 107 and second arm portion 108 may be portions of the plate 105 and may be constructed in various lengths. For example, the first arm portion 107 may be longer than the second arm portion 108, or the first arm portion 107 may be shorter than the second arm portion 108. In an alternative embodiment, the first arm portion 107 and second arm portion 108 may be substantially the same length or equal in length. However, in a preferred embodiment, the first arm portion 107 is generally longer than the second arm portion 108 and may be 5 units in length from the center point of the hole 106 or axle-bearing 103. In that embodiment, the second arm portion 108 may be 3 units in length from the center point of the hole 106 or axle-bearing 103. Thus, in a preferred embodiment, there may be a ratio of 5:3 in length for the first arm portion 107 to the second arm portion 108.

Regarding the position and alignment between the first arm portion 107 and the second arm portion 108, the first arm portion 107 may be angled or aligned away from the second arm portion 108 in various degrees. For example, in an embodiment, the first arm portion 107 may be angled from the second arm portion 108 between approximately 130° and 140° degrees. In a preferred embodiment, the first arm portion 107 may be angled or aligned away from the second arm portion 108 in approximately 135° degrees (shown in FIG. 2).

In various embodiments, the barbell collar 100 may also comprise an axle-bearing 103 that may allow the barbell collar to lock into a certain position at the end portions of the barbell. The axle-bearing 103 may be positioned at the hole 106, and may be configured to allow the barbell collar to limit rotation of the barbell collar 100 or lock into a certain position around the barbell. Alternatively, the axle-bearing 103 may also allow the barbell collar 100 to freely rotate 360° degrees around the barbell. In an embodiment, the axle bearing may be removable from the barbell.

During use, the barbell collar 100 may allow the user to experience various exercise positions and resistance. This is generally because the first weight bar 110 and second weight bar 115 are generally configured to freely rotate relative to the end portion on the barbell. For example, during use of the barbell collar 100, the user may face towards the concave portion of the barbell collar 100 (e.g., the 135 degree portion of the barbell collar 100 in-between the first arm portion 107 and second arm portion 108). Alternatively, during use of the barbell collar 100, the user may face the convex portion of the barbell collar 100 (e.g., the 225 degrees portion in-between the first arm portion 107 and second arm portion 108 of the barbell collar 100). The user may also position the barbell collars in a manner such that the user may face the concave portion of one barbell collar while, at the same time, face the convex portion of another barbell collar. As a result, the user may experience resistance through the sagittal plane, the coronal plane, the transverse plane, and the horizontal plane, or any combinations thereof.

When disc weights are not loaded onto the barbell collar 100, the arm portions of the plate 105 may be positioned at various degrees relative to the barbell. For example, the first arm portion 107 may be positioned at an angle of approximately 90° degrees relative to the barbell's horizontal plane when the barbell and barbell collar 100 are not in contact with any surface. Additionally, the second arm portion 108 may be positioned at approximately 45° degrees relative to the barbell's horizontal plane when the barbell and barbell collar 100 are not in contact with any surface. However, various positions may be configured to the first arm portion 107, second arm portion 108, or combination thereof, thereby influencing the position of the arm portions relative to the horizontal plane of the barbell 50. The manner in which the barbell 50 may move may also further influence the position of the arms relative to the horizontal plane of the barbell 50.

Figure 2:
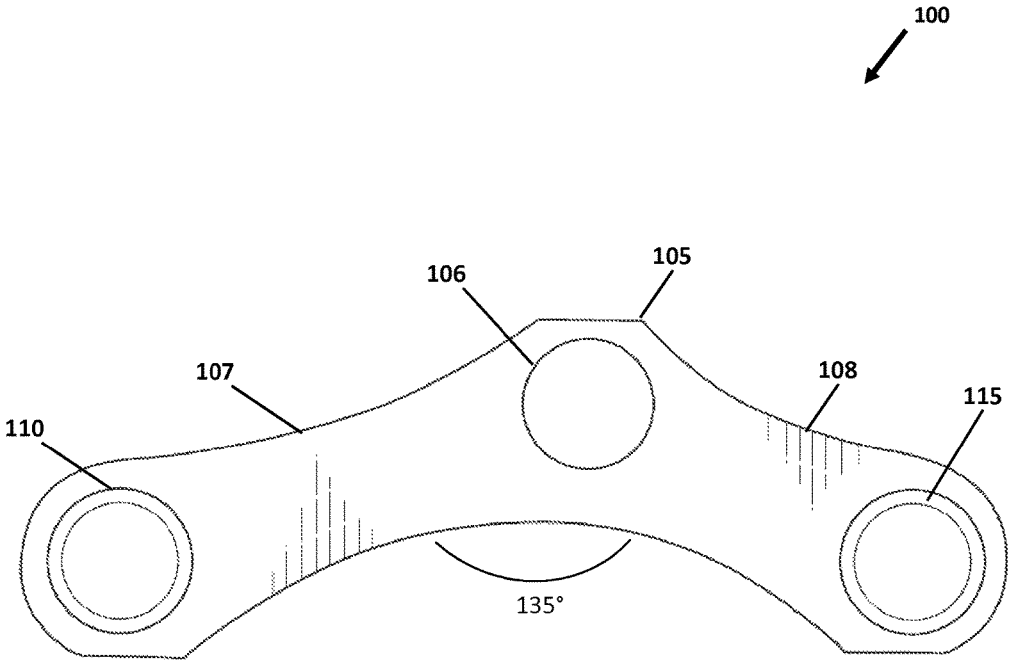
FIG. 2 is an illustration of a side view of one embodiment of the barbell collar.

FIG. 2 is an illustration of a side view of one embodiment of the barbell collar. As shown in FIG. 2, one embodiment of the barbell collar 100 may comprise: a plate 105, first weight bar 110, and second weight bar 115, wherein the plate 105 may comprise: a hole 106, first arm portion 107, and second arm portion 108. FIG. 2 shows that the first arm portion 107 may be longer than the second arm portion 108 and may be angled at approximately 135° degrees from the second arm portion 108. In a preferred embodiment, the first arm portion 107 may measure approximately 5 units in length from the center point of the hole 106 or axle bearing 103. The second arm portion 108 may also be measured approximately 3 units in length from the center point of the hole 106 or axle bearing 103. Thus, the length of the first arm portion 107 to the second arm portion 108 may be a ratio of approximately 5:3.

Figure 3A:
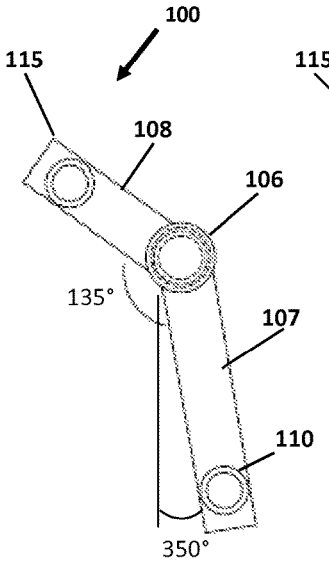
FIGS. 3*a*-3*c* are illustrations of a side view of one embodiment of the barbell collar, and shows the barbell collar angled in various positions, which may affect the amount of resistance a user experiences when using the barbell collar.
Figure 3B:
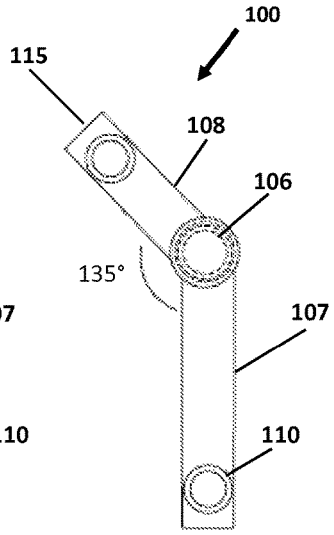
Figure 3C:
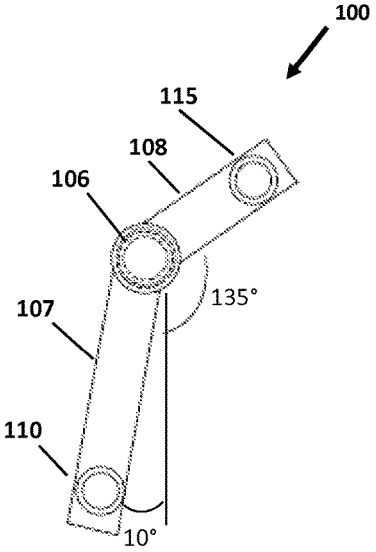

FIGS. 3*a*-3*c* are illustrations of a side view of one embodiment of the barbell collar, and shows the barbell collar angled in various positions, which may affect the amount of resistance a user experiences when using the barbell collar. Specifically, FIGS. 3*a*-3*c* show that the barbell collar may be positioned in various degrees around the barbell by locking the axle-bearing 103 of the barbell collar 100 to the barbell. As shown in FIGS. 3*a*-3*c*, one embodiment of the barbell collar 100 may comprise: an axle-bearing 103, plate 105, first weight bar 110, and second weight bar 115, wherein the plate 105 may comprise: a hole 106, first arm portion 107, and second arm portion 108.

FIG. 3*a* shows that the first arm portion 107 may be angled at approximately 350° degrees relative to the center pull of gravity. In this configuration, any disc weights added to the second arm portion 108 may preferably be less than the disc weights added to the first arm portion 107.

FIG. 3*b* shows that the first arm portion 107 may be angled at approximately 0° degrees relative to the center pull of gravity (or approximately 90° relative to the horizontal plane). Preferably, in this configuration no additional disc weights are added to the second arm portion 108. Additionally, first arm portion 107 may have added disc weights.

FIG. 3*c* shows that the first arm portion 107 may be angled at approximately 10° degrees relative to the center pull of gravity. In this configuration, the disc weights added to the second arm portion 108 may also be less that the disc weights added to the first arm portion 107.

Lombard's Paradox

Under Lombard's Paradox, a paradoxical muscular contraction occurs towards the hamstrings and quadriceps when a person sits or squats. Specifically, when rising to stand from a sitting or squatting position, both the hamstrings and quadriceps typically contract at the same time, despite themselves being antagonists to each other. In the up phase of a squat, the quadriceps contract to cause extension of the knee joint while the hamstrings are contracting to cause extension of the hip joint. Thus, it may be surprising to find that all these muscles are active, as they are responsible for causing different actions. For example, in theory, these muscle groups should neutralize the others movements, with no resultant movement.

In particular, when a person is rising from a chair, both (a) the rectus femoris, which is a knee extensor and hip flexor, and (b) two-joint hamstrings, which are hip extensors and knee flexors are active. These muscles are considered anatomical antagonists, and their movements are vectors located in opposite quadrants in the knee-hip moment arm plane. The paradox occurs because both the rectus femoris and hamstrings are co-activated during this task, even if their actions oppose each other. While it appears that both muscles provide both a positive and negative contribution to leg extension, the contraction from both the rectus femoris and the hamstrings will generally result in a hip and knee extension. This illustrates that, with certain tasks of movement, there may exist a ratio of involvement of skeletal muscles that may be considered anatomic antagonists but behave as task agonists. The above described task of "rising from a chair" is similar to rising during the ascent of a squat exercise.

In this case, the adjustability and potential variables of the barbell collar may influence the ratio of skeletal muscle involvement for a given task where the barbell and barbell collars are utilized versus using a barbell without the present apparatus. This is in part due to the position of the resistance relative the horizontal plane of the barbell as well as the manner in which the task is performed as it relates to influencing the position of the resistance as it relates to the horizontal plane of the barbell. Thus, in some movements with simultaneous knee and hip extension (e.g., rising from a chair or squat exercises), the barbell collar may affect and influence the reaction of the hamstrings and rectus femoris as well as the ratio of the hamstring to the rectus femoris.

Force-Length Relationship

Figure 4:
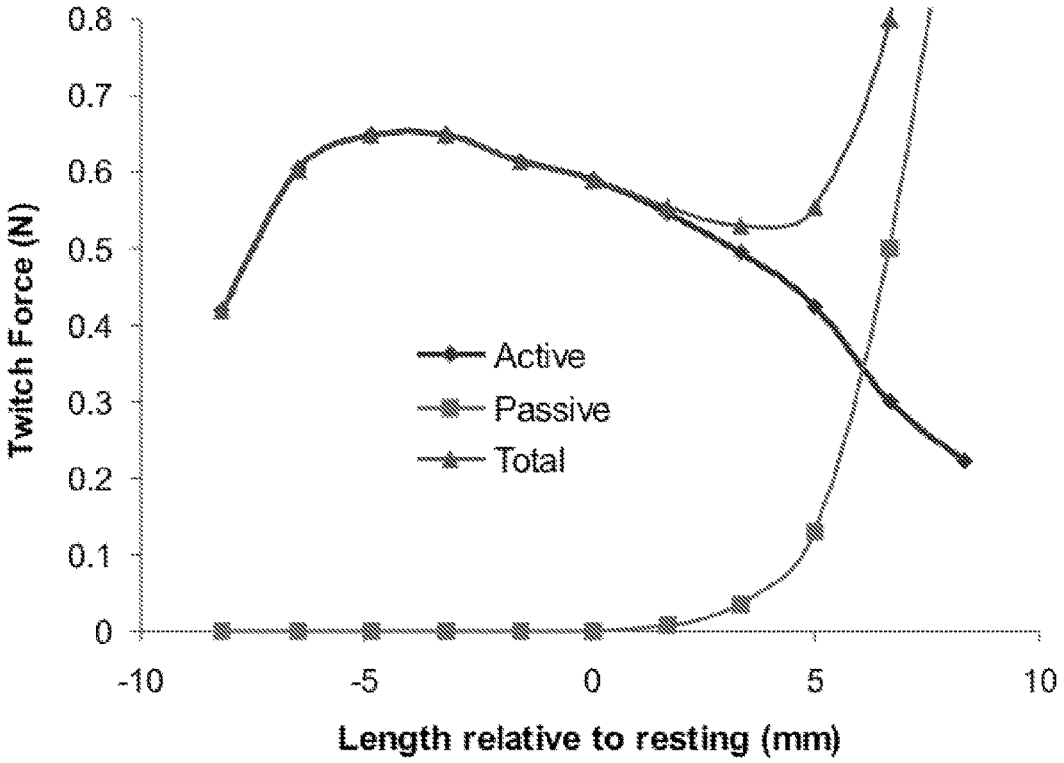
FIG. 4 is a graph that shows the relationship between the strength or force of an isometric contraction and the length of a muscle at which the contraction occurs.

FIG. 4 is a graph that shows the relationship between the strength or force of an isometric contraction and the length of a muscle at which the contraction occurs. As shown in FIG. 4, muscles usually function with the greatest active force when close to an ideal length, which is often their resting length. When the muscle is stretched or shortened beyond this ideal length (which may be caused by the muscle itself or by an outside force), the maximum force generated typically decreases. As the muscle is stretched beyond a given length, there is generally, in response, a passive force, which usually opposes lengthening. Thus, when combined together, the resistance to lengthening an active muscle may occur far beyond the peak of active force. Here, when utilizing the barbell collar, it is intended that the barbell collar be configured to affect and influence the relationship between the force of contraction and the length of a muscle at which the contraction occurs.

Force-Velocity Relationship

Figure 5:
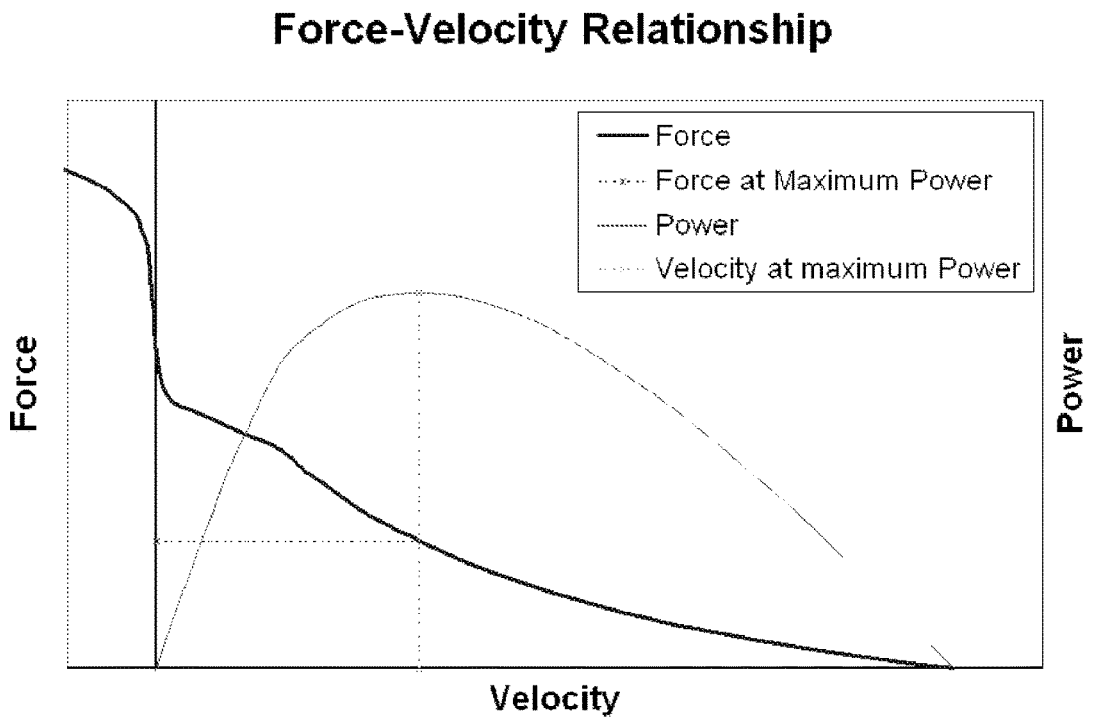
FIG. 5 is a graph that shows the relationship between the strength or force of an isometric contraction and the speed at which the muscle contraction occurs.

FIG. 5 is a graph that shows the relationship between the strength or force of an isometric contraction and the speed at which the muscle contraction occurs. As shown in FIG. 5, the speed at which a muscle changes length may also affect the force that the muscle can generate. Force generally declines relative to the isometric force and usually in a hyperbolic fashion, such that, as the velocity increases, the force may reach some maximum velocity at a certain point. Conversely, the same is true when a muscle is stretched—force generally increases above the maximum velocity. Since power equals to the product of force and velocity, no power is generated at the maximum velocity and the peak of the isometric force. Thus, the ideal velocity for power generation is approximately one-third the maximum shortening velocity. It is intended that the barbell collar be configured to affect this ideal velocity for maximum power generation.

Torque Overshoot

When overcoming resistance in strength training activities, the load range of the resistance may become increasingly smaller as velocity is increased. This may result with a torque spike or torque overshoot caused by the preceding velocity overshoot. Torque spikes or torque overshoots generally occur when the person's limbs accelerates past the desired speed. As a result, an offshoot may occur and may be caused by the preceding velocity overshoot. Here, the barbell collar is preferably configured to force the user to maintain control to avoid torque overshoot, which may result in an actual increase in force generation by the muscle.

Muscle-Tendon Behavior

The functionality of the contracting portions of the tendons during movement is often tightly integrated with performance of a user's muscle. Tendons are generally capable in enhancing muscle performance for a wide range of motion activities because muscles and tendons usually shorten and/or lengthen at velocities that would normally be mechanically unfavorable for muscle fibers functioning alone. For example, some activities that require less mechanical power output (e.g., jogging) generally cause tendons to reduce muscular work. This occurs because the tendons generally store and recover cyclic changes in the mechanical energy of a person's body. Tendon stretching and recoils may also reduce muscular work by allowing fibers to operate isometrically without much change in muscles contraction. Importantly, the tendon structures generally function not only as an energy redistributor, but also as a power amplifier. This is based upon the force-length/velocity relationships of each element (contractile and series elastic elements) in the muscle-tendon complex during movements.

One example may also be in a situation involving barbell exercises. When lifting or moving a barbell, the user may "bounce off" a tendon to overcome some form of resistance. This may occur due to the shortening and/or lengthening of tendons at certain velocities, especially in weightlifting. However, when utilizing the barbell collar, the user preferably loses the advantage of "bouncing off" a tendon when overcoming the resistance. As a result, the tendon is usually not subjected to any energy transfer via an elastic stretch-recoil. This is due to the barbell collar's ability to freely rotate, since such movement may cause the "bounce off" to be impractical. As such, the user may depend upon the contracting muscle fiber more than the tendon to influence the position of the resistance.

Figure 6:
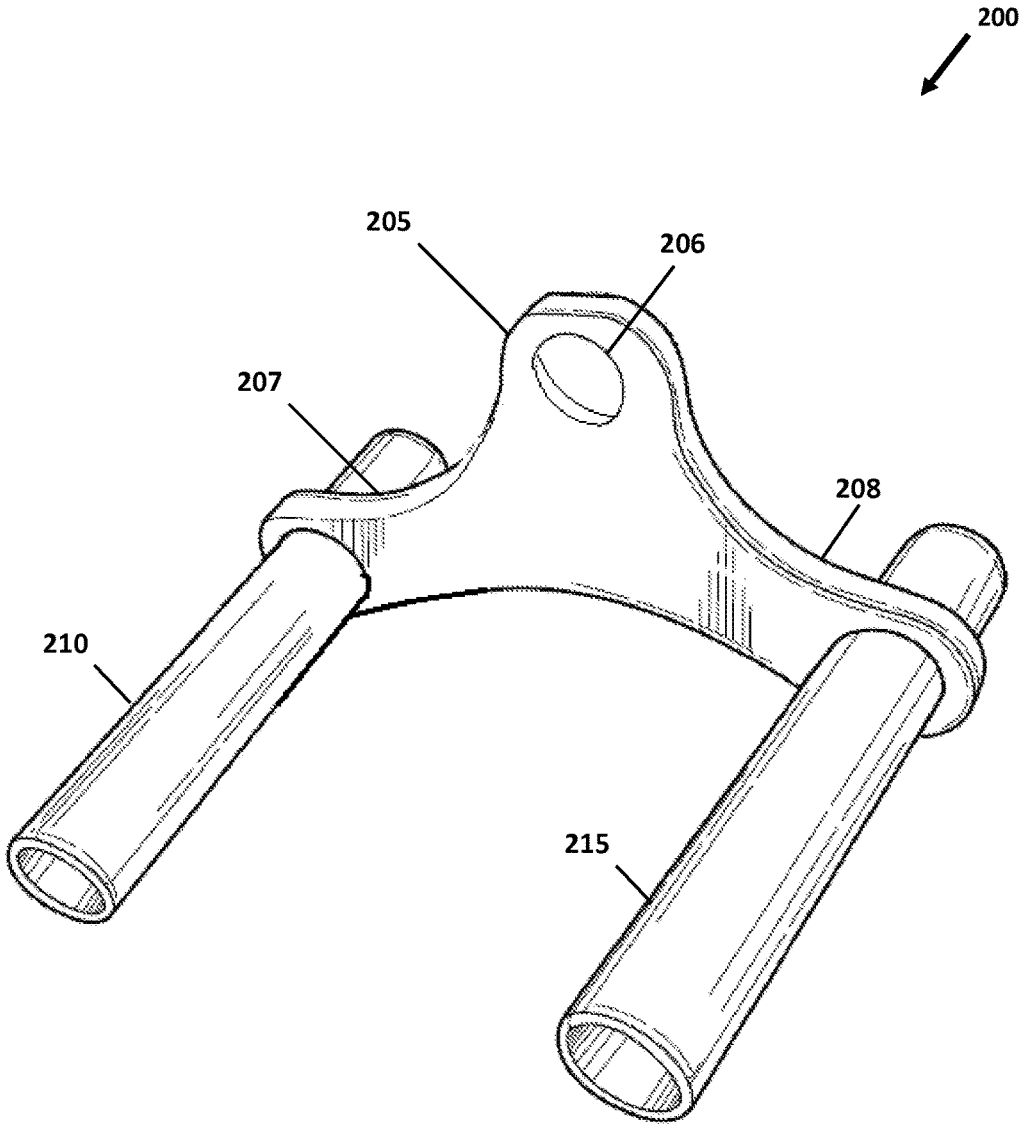
FIG. 6 is an illustration of a top perspective view of another embodiment of a barbell collar.

FIG. 6 is an illustration of a top perspective view of another embodiment of a barbell collar. As shown in FIG. 6, another embodiment of the barbell collar 200 may comprise: a plate 205, first weight bar 210, and second weight bar 215, wherein the plate 205 may comprise: a hole 206, first arm portion 207, and second arm portion 208. Unlike the barbell collar 100 shown in FIGS. 1-3, which comprises a v-shaped plate 105, the barbell collar 200 shown in FIGS. 4-5 may comprise a plate 205 that is substantially y-shaped.

Figure 7:
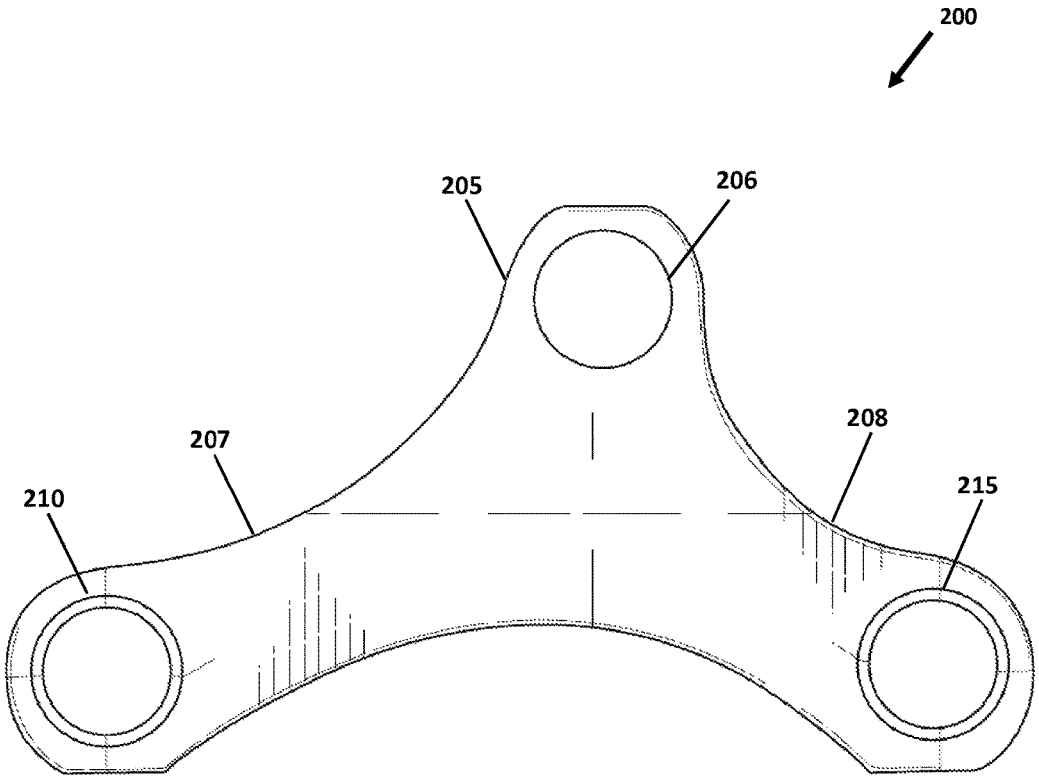
FIG. 7 is an illustration of a side view of another embodiment of the barbell collar.

FIG. 7 is an illustration of a side view of another embodiment of the barbell collar. As shown in FIG. 7, another embodiment of the barbell collar 200 may comprise: a plate 205, first weight bar 210, and second weight bar 215, wherein the plate 205 may comprise: a hole 206, first arm portion 207, and second arm portion 208.

Figure 8:
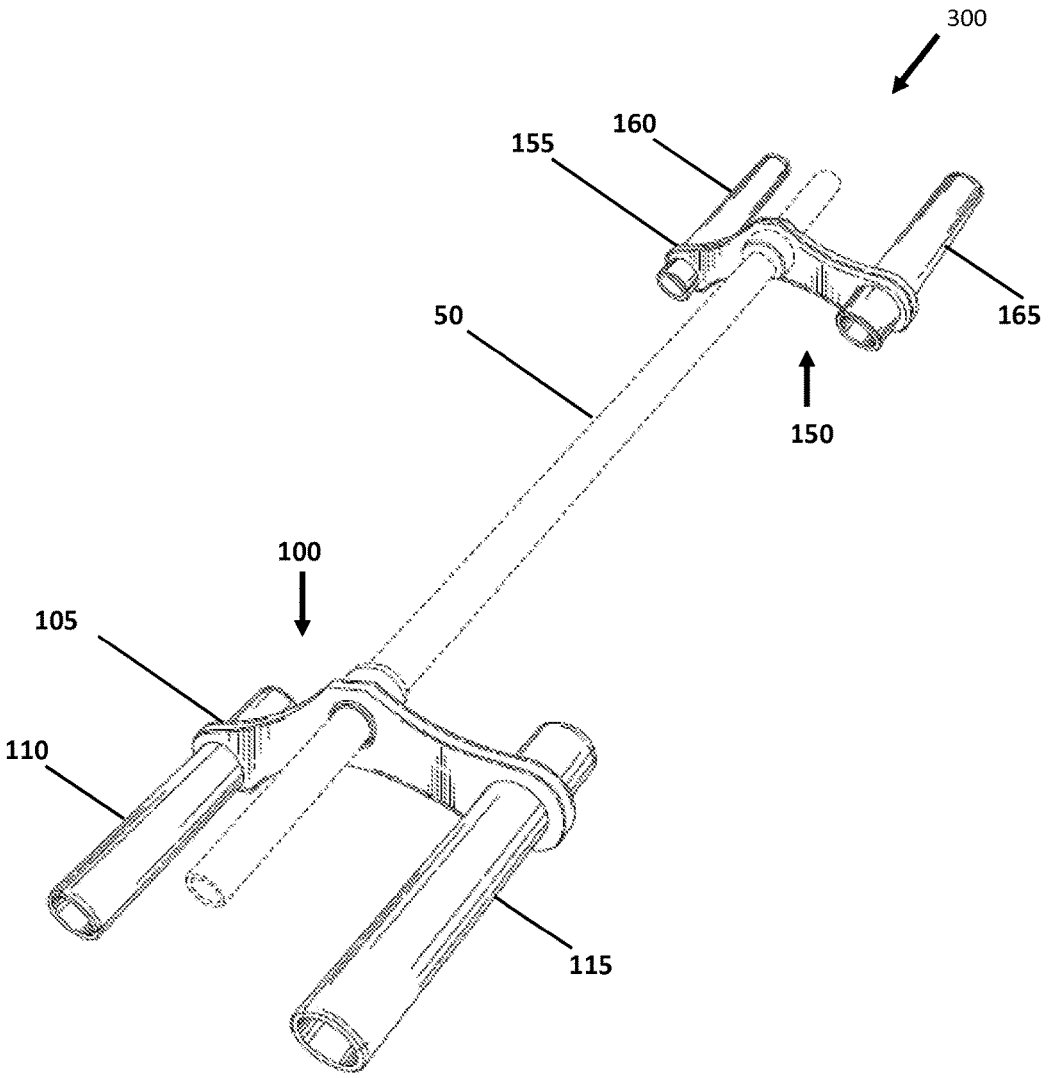
FIG. 8 is an illustration of a top perspective view of one embodiment of a barbell system.

FIG. 8 is an illustration of a top perspective view of one embodiment of a barbell system. As shown in FIG. 8, one embodiment of the barbell system 300 may comprise: a barbell 50, first barbell collar 100, and second barbell collar 150. The first barbell collar 100 may comprise: a first plate 105, first weight bar 110, and second weight bar 115. The second barbell collar 150 may comprise: a second plate 155, third weight bar 160, and fourth weight bar 165. FIG. 8 also shows that two barbell collars are generally used for each barbell system 300. When a barbell collar 100, 150 is attached to a barbell 50, additional disc plates may be attached to the barbell collar 100, 150 via the first weight bar 110, second weight bar 160, third weight bar weight bar 155, and fourth weight bar 165 and also the ends of the barbell 50 itself. In this barbell system 300, the barbell collars 100, 150 may comprise plates 105 and 155 that are substantially v-shaped.

When the barbell collars 100, 150 are without disc weights, the first arm portions (e.g., first arm portion and third arm portion) of the barbell collars 100, 150 may be positioned in various configurations. For example, the first arm portions may be positioned in approximately 90° degrees relative to the barbell's horizontal plane when the barbell 50 and barbell collars 100, 150 are not in contact with the ground surface. Additionally, the second arm portions (e.g., second arm portion and fourth arm portion) of the barbell collars 100, 150 may be positioned at approximately 45° degrees from the horizontal plane of the barbell 50.

When the barbell collars 100, 150 are loaded with disc plates, however, additional combinations of weight resistances may be applied to the arm portions, thereby influencing the position of the arm portions relative to the horizontal plane of the barbell 50. Importantly, the manner in which the barbell 50 moves may further influence the position of the arm portions relative to the horizontal plane of the barbell 50. For example, in an embodiment, it may be possible that a stationary form of resistance could secure the arm portions in a relative position to the horizontal plane of the barbell 50.

Figure 9:
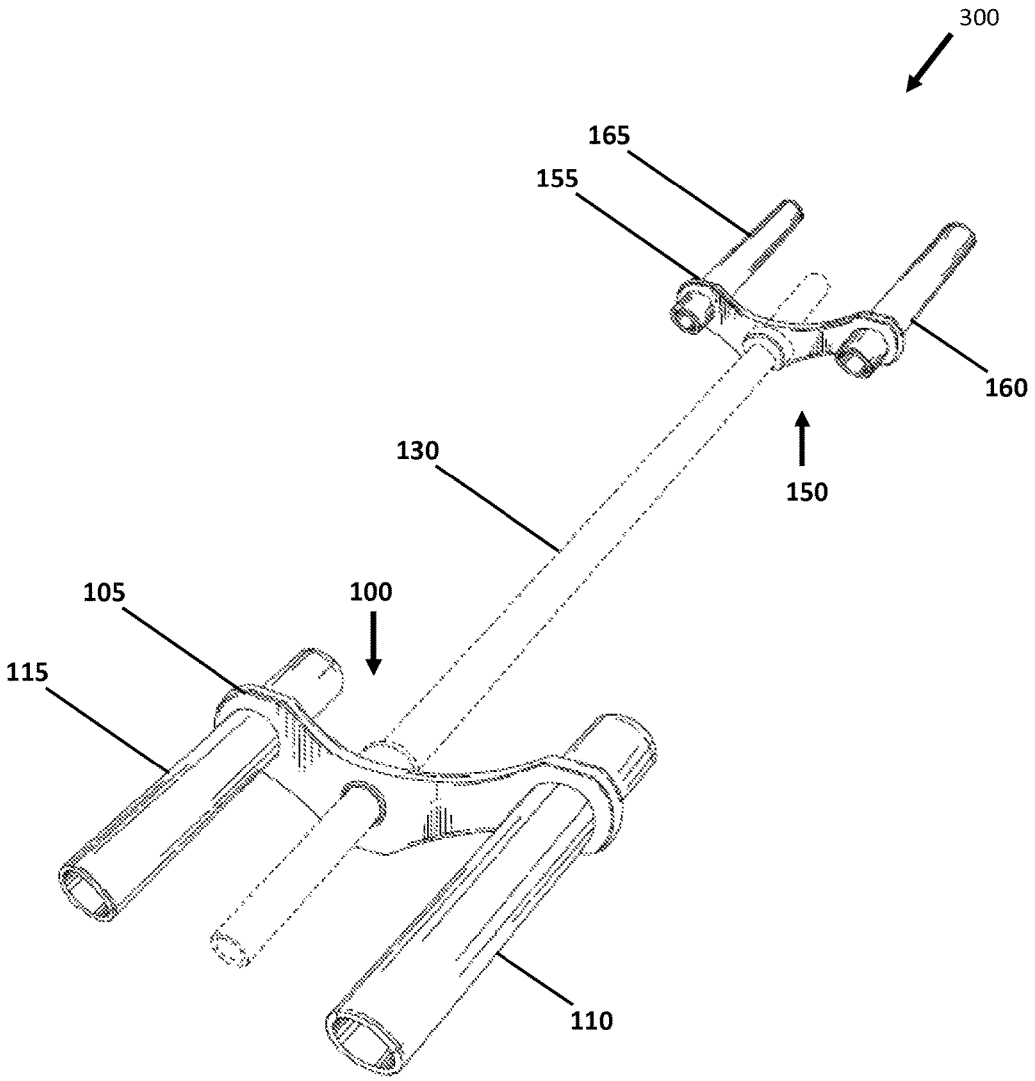
FIG. 9 is an illustration of a bottom perspective view of one embodiment of the barbell system.

FIG. 9 is an illustration of a bottom perspective view of one embodiment of the barbell system. As shown in FIG. 9, one embodiment of the barbell system 300 may comprise: a barbell 50, first barbell collar 100, and second barbell collar 150. The first barbell collar 100 may comprise: a first plate 105, first weight bar 110, and second weight bar 115. The second barbell collar 150 may comprise: a second plate 155, third weight bar 160, and fourth weight bar 165.

Figure 10:
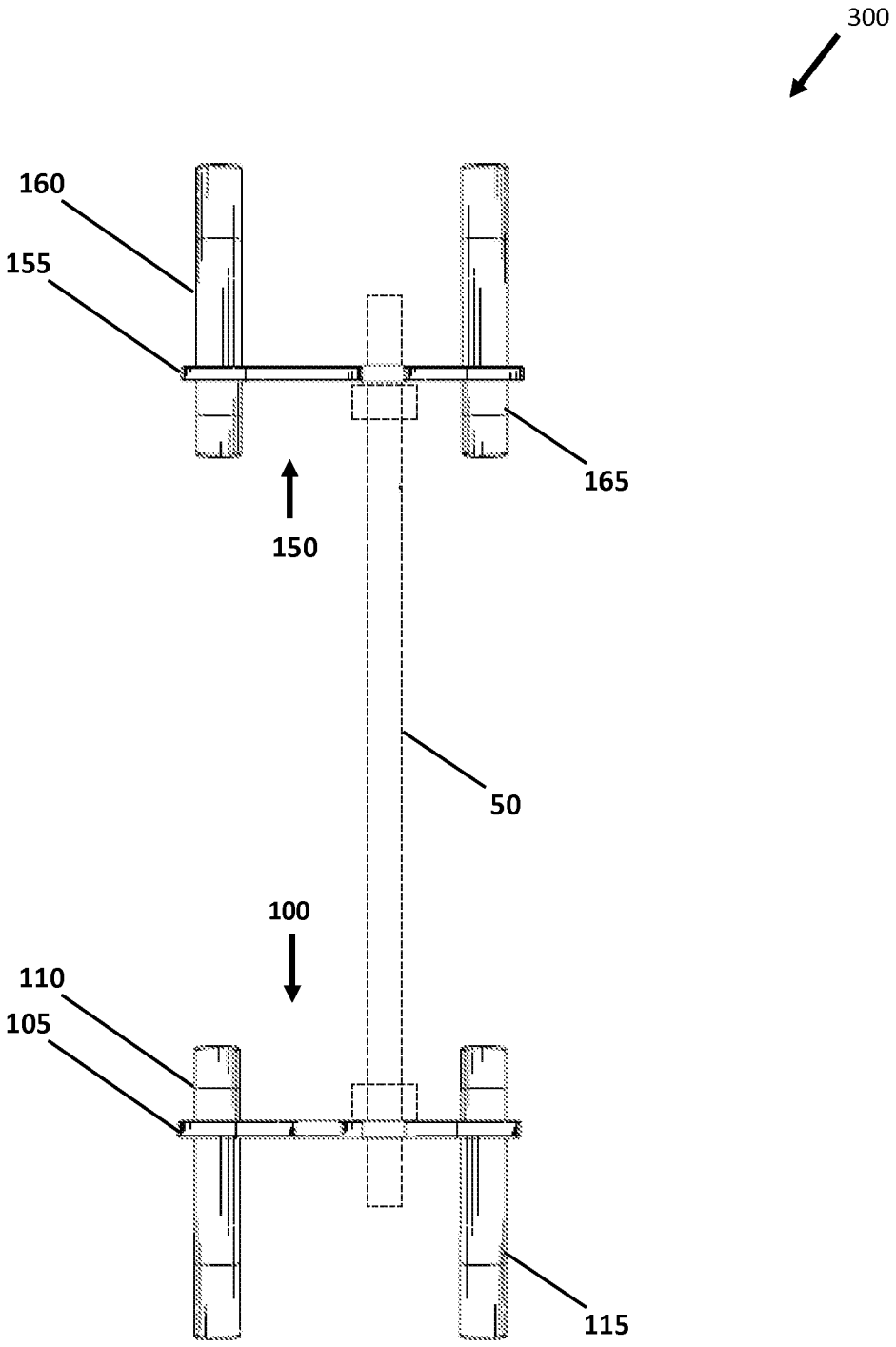
FIG. 10 is an illustration of a top plan view of one embodiment of the barbell system.

FIG. 10 is an illustration of a top plan view of one embodiment of the barbell system. As shown in FIG. 10, one embodiment of the barbell system 300 may comprise: a barbell 50, first barbell collar 100, and second barbell collar 150. The first barbell collar 100 may comprise: a first plate 105, first weight bar 110, and second weight bar 115. The second barbell collar 150 may comprise: a second plate 155, third weight bar 160, and fourth weight bar 165.

Figure 11:
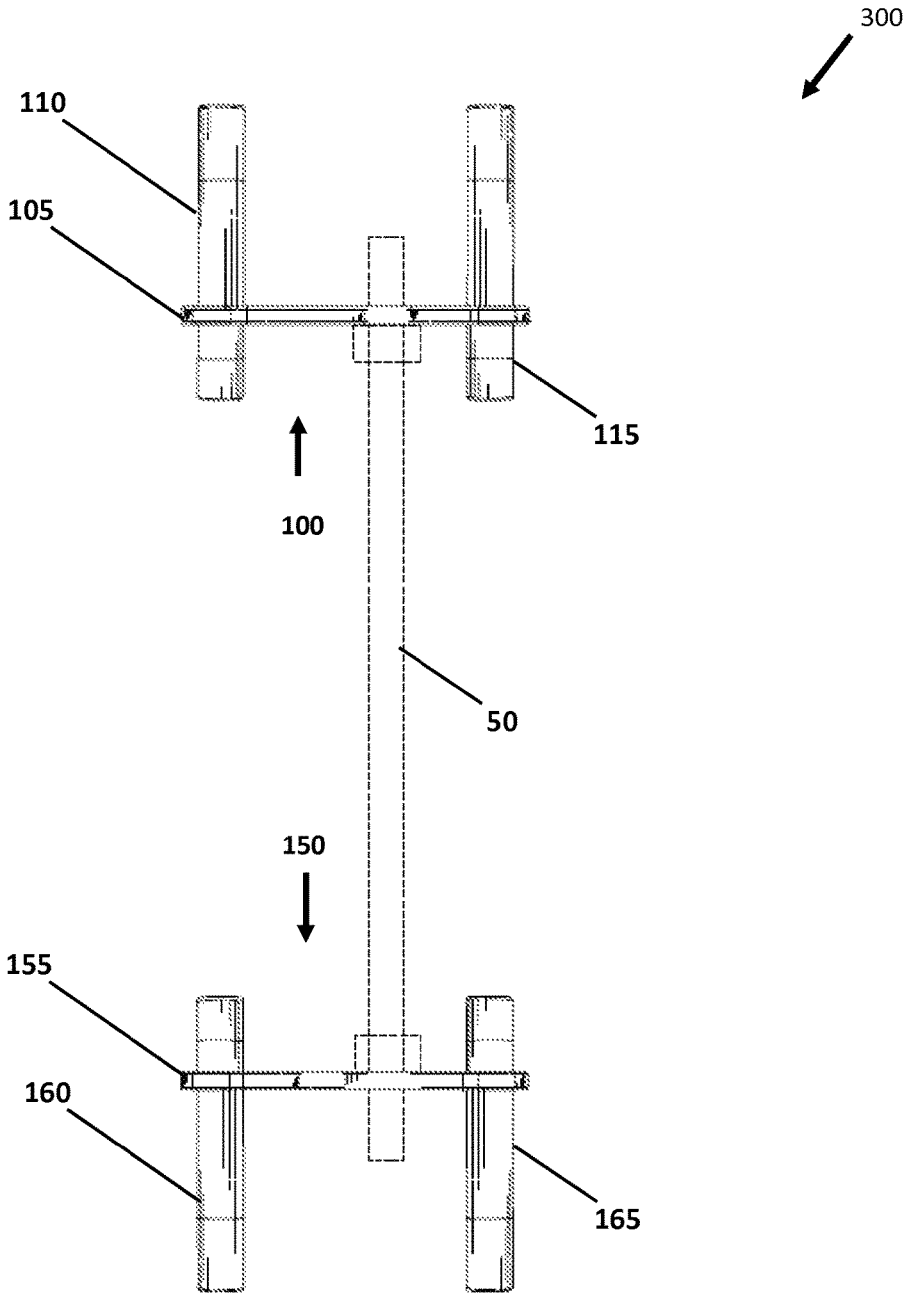
FIG. 11 is an illustration of a bottom plan view of one embodiment of the barbell system.

FIG. 11 is an illustration of a bottom plan view of one embodiment of the barbell system. As shown in FIG. 11, one embodiment of the barbell system 300 may comprise: a barbell 50, first barbell collar 100, and second barbell collar 150. The first barbell collar 100 may comprise: a first plate 105, first weight bar 110, and second weight bar 115. The second barbell collar 150 may comprise: a second plate 155, third weight bar 160, and fourth weight bar 165.

Figure 12:
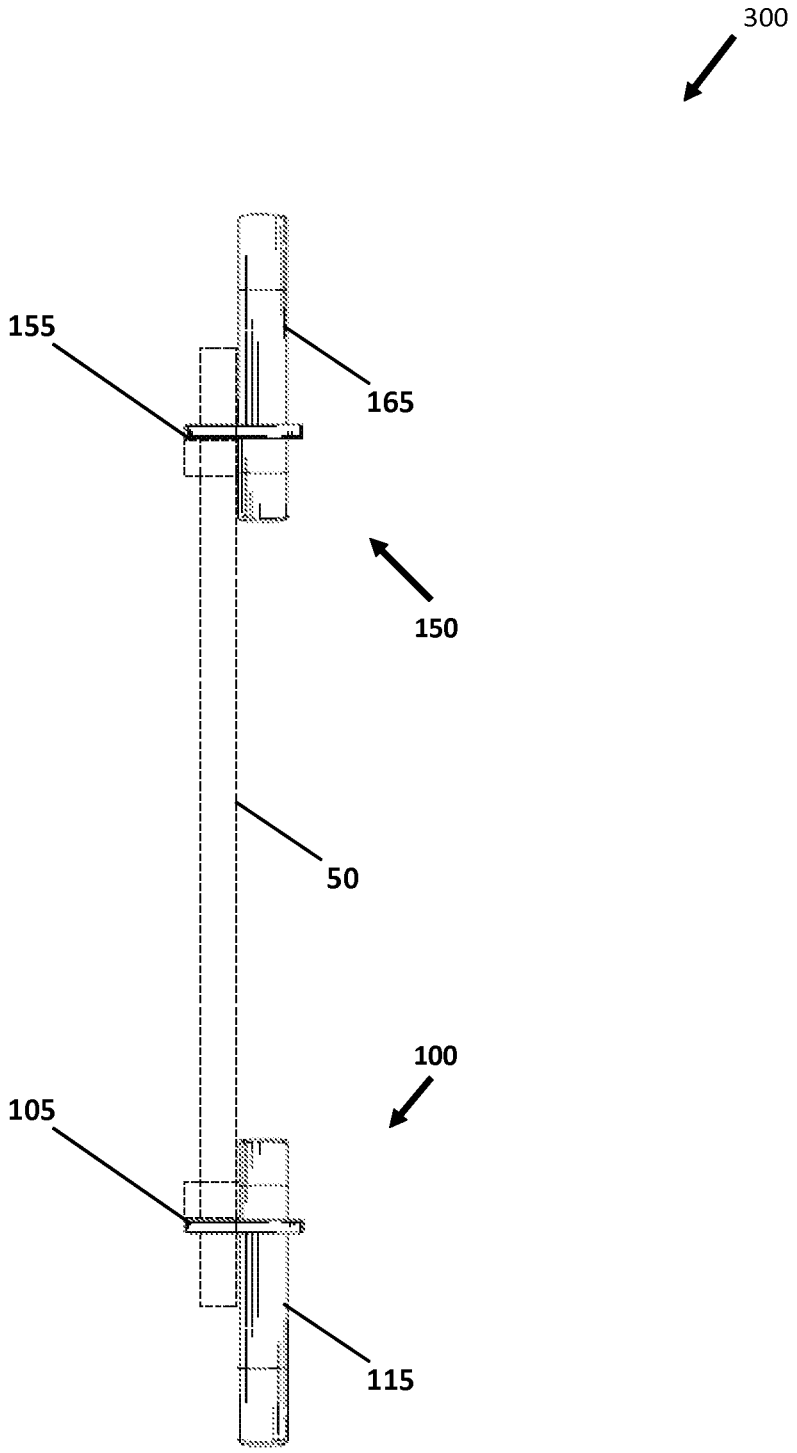
FIG. 12 is an illustration of a left side elevational view of one embodiment of the barbell system.

FIG. 12 is an illustration of a left side elevational view of one embodiment of the barbell system. As shown in FIG. 12, one embodiment of the barbell system 300 may comprise: a barbell 50, first barbell collar 100, and second barbell collar 150. The first barbell collar 100 may comprise: a first plate 105 and second weight bar 115. The second barbell collar 150 may comprise: a second plate 155 and fourth weight bar 165.

Figure 13:
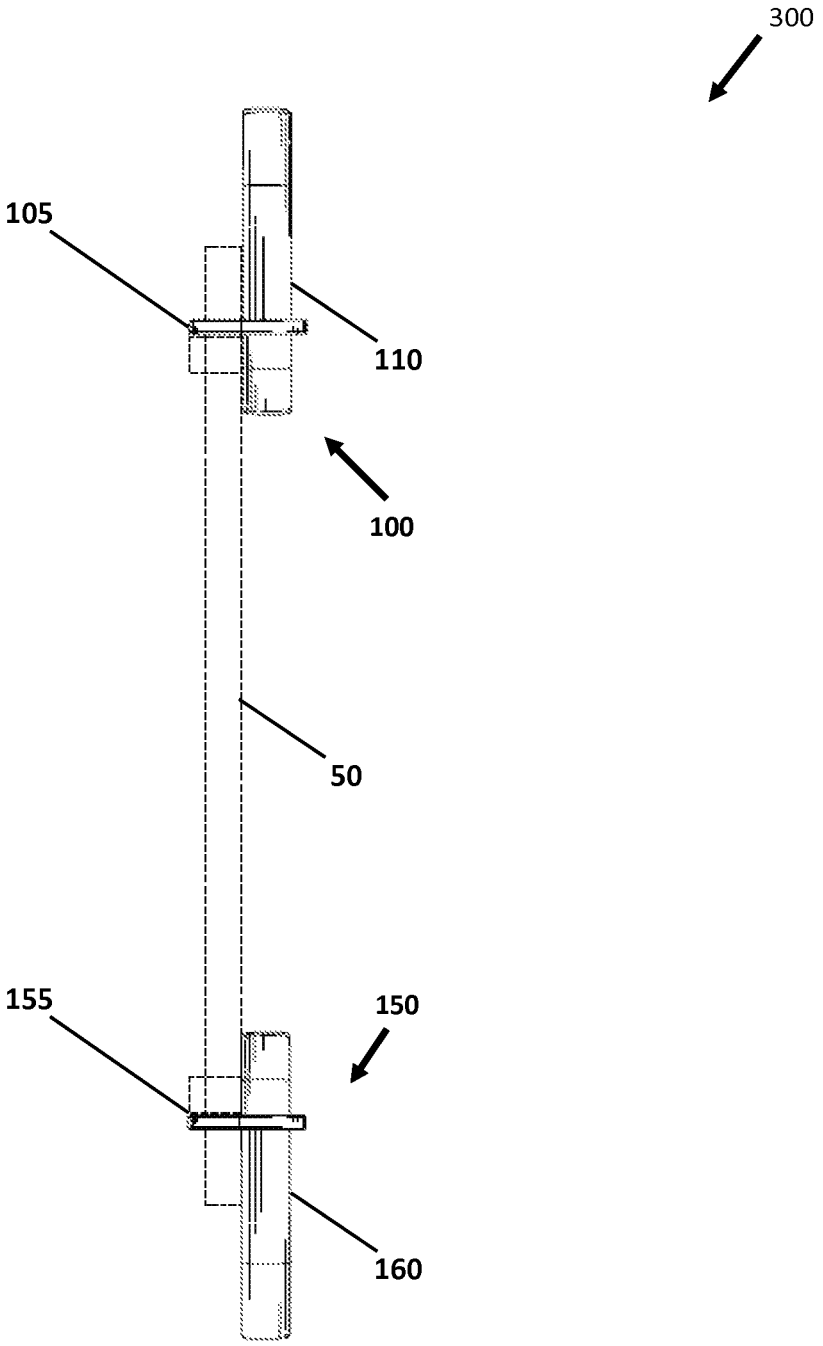
FIG. 13 is an illustration of a right side elevational view of one embodiment of the barbell system.

FIG. 13 is an illustration of a right side elevational view of one embodiment of the barbell system. As shown in FIG. 13, one embodiment of the barbell system 300 may comprise: a barbell 50, first barbell collar 100, and second barbell collar 150. The first barbell collar 100 may comprise: a first plate 105 and first weight bar 110. The second barbell collar 150 may comprise: a second plate 155 and third weight bar 160.

Figure 14:
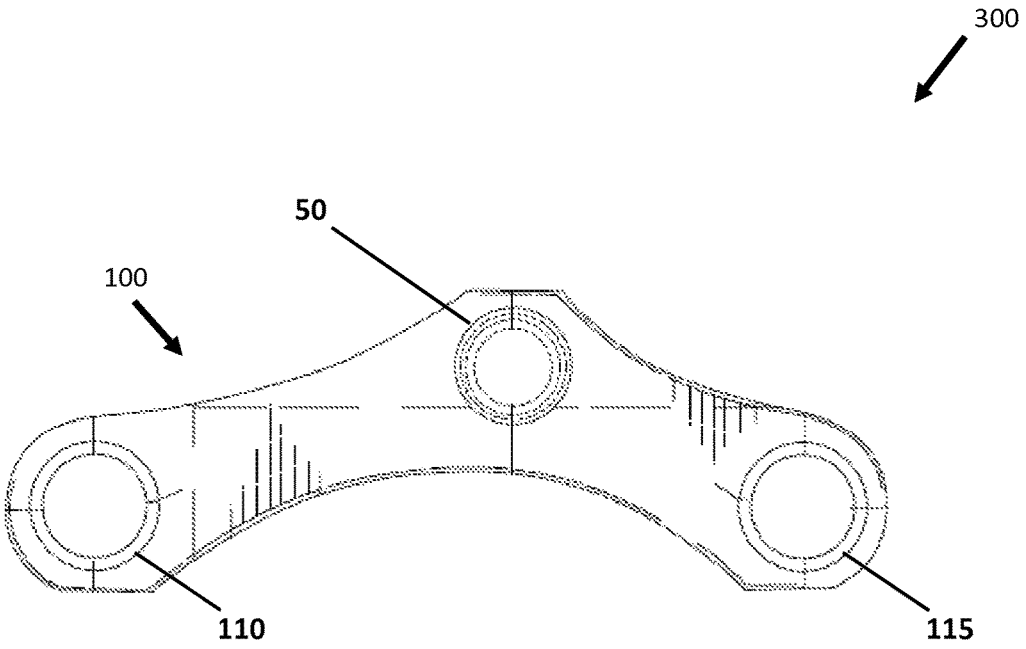
FIG. 14 is an illustration of a front elevational view of one embodiment of the barbell system.

FIG. 14 is an illustration of a front elevational view of one embodiment of the barbell system. As shown in FIG. 14, one embodiment of the barbell system 300 may comprise: a barbell 50 and first barbell collar 100. The first barbell collar 100 may comprise: a first plate 105, first weight bar 110, and second weight bar 115.

Figure 15:
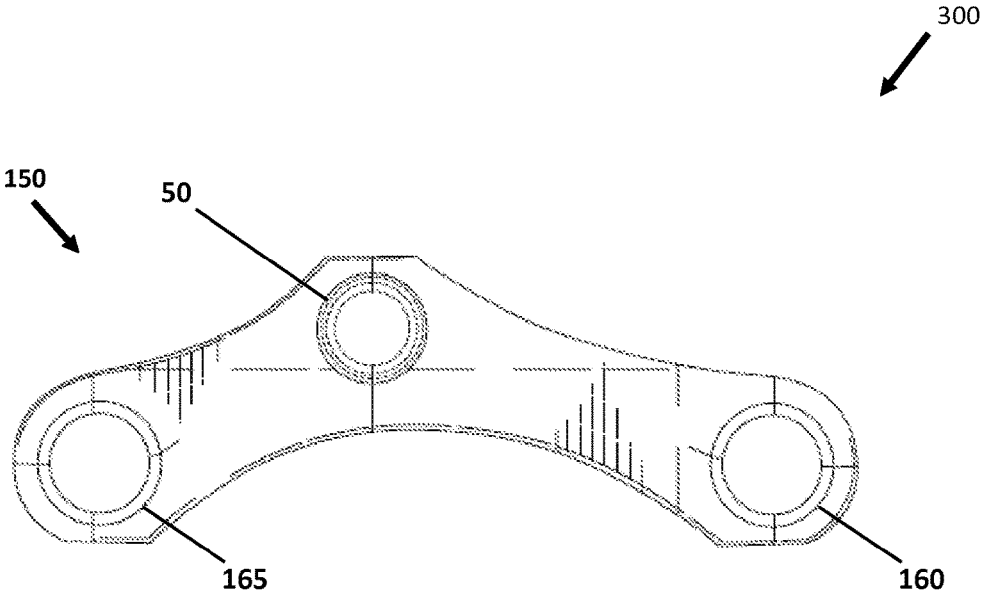
FIG. 15 is an illustration of a rear elevational view of one embodiment of the barbell system.

FIG. 15 is an illustration of a rear elevational view of one embodiment of the barbell system. As shown in FIG. 15, one embodiment of the barbell system 300 may comprise: a barbell 50 and second barbell collar 150. The second barbell collar 150 may comprise: a second plate 155, third weight bar 160, and fourth weight bar 165.

Figure 16:
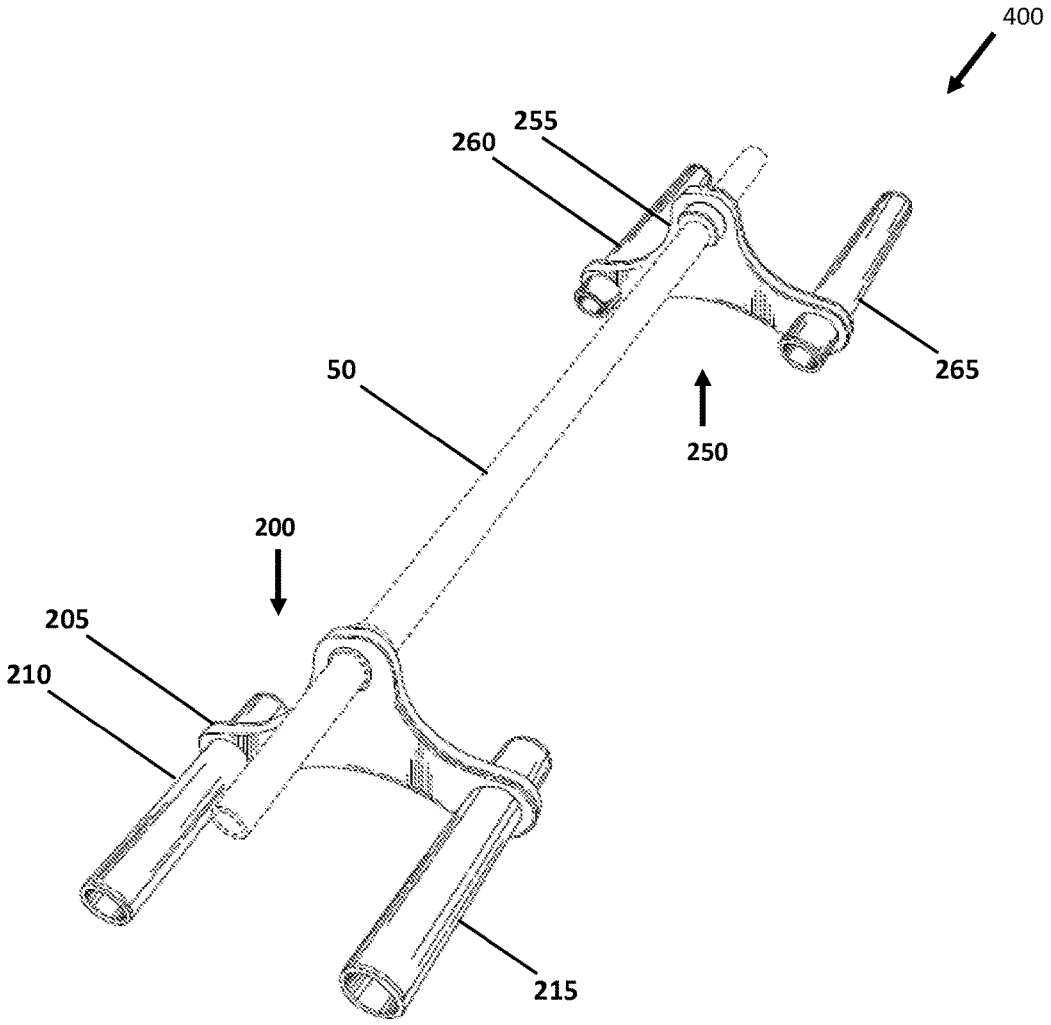
FIG. 16 is an illustration of a top perspective view of another embodiment of a barbell system.

FIG. 16 is an illustration of a top perspective view of another embodiment of a barbell system. As shown in FIG. 16, another embodiment of the barbell system 400 may comprise: a barbell 50, a first barbell collar 200, and a second barbell collar 250. The first barbell collar 200 may comprise: a first plate 205, first weight bar 210, and second weight bar 215. The second barbell collar 250 may comprise: a second plate 255, third weight bar 260, and fourth weight bar 265. In this barbell system 400, the barbell collar 200, 250 may comprise plates 205, 255 that are substantially v-shaped.

Figure 17:
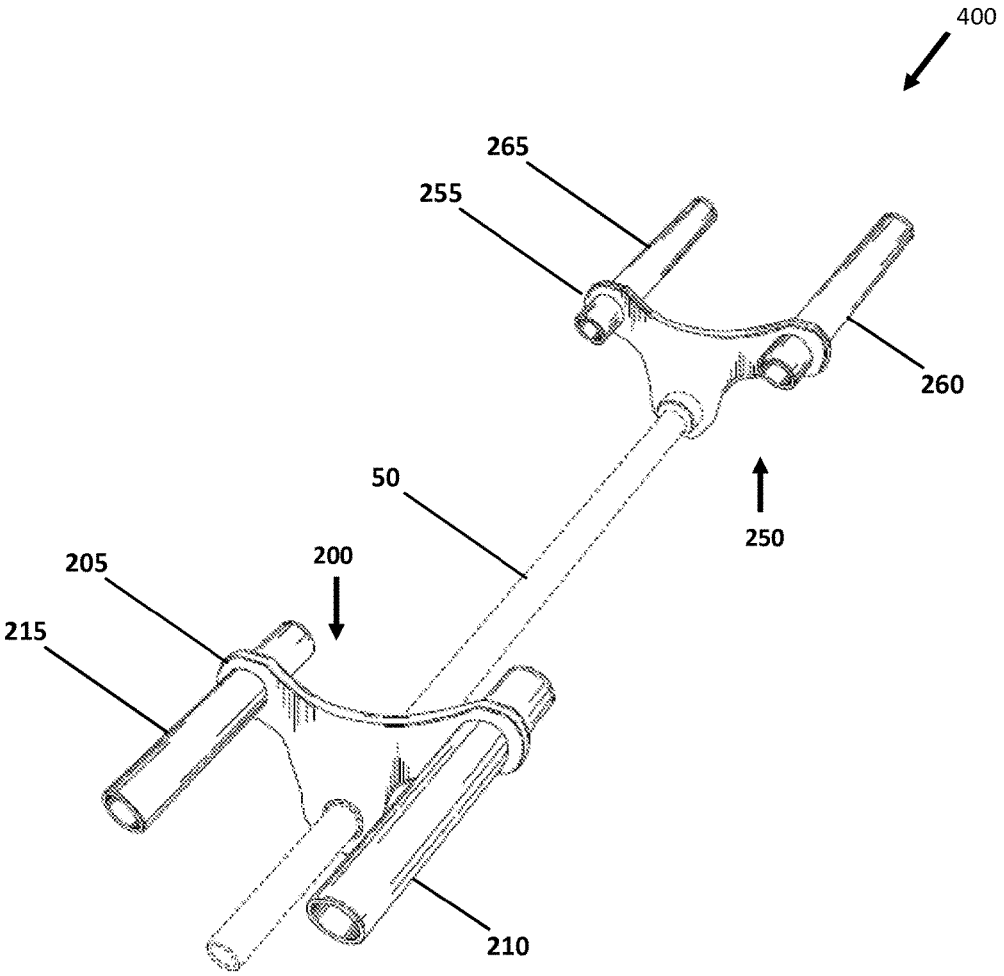
FIG. 17 is an illustration of a bottom perspective view of another embodiment of the barbell system.

FIG. 17 is an illustration of a bottom perspective view of another embodiment of the barbell system. As shown in FIG. 17, another embodiment of the barbell system 400 may comprise: a barbell 50, first barbell collar 200, and second barbell collar 250. The first barbell collar 200 may comprise: a first plate 205, first weight bar 210, and second weight bar 215. The second barbell collar 250 may comprise: a second plate 255, third weight bar 260, and fourth weight bar 265.

Figure 18:
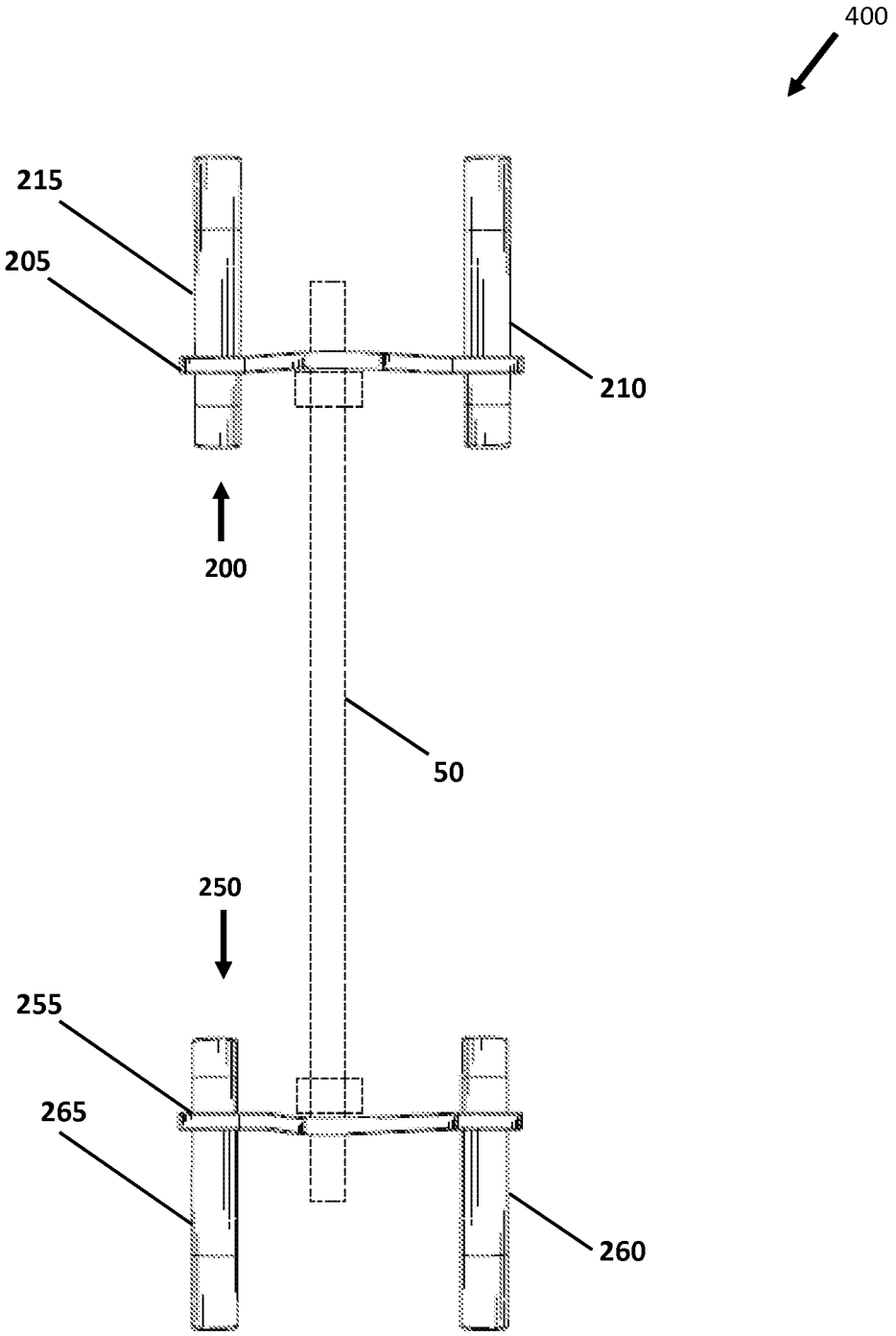
FIG. 18 is an illustration of a top plan view of another embodiment of the barbell system.

FIG. 18 is an illustration of a top plan view of another embodiment of the barbell system. As shown in FIG. 18, another embodiment of the barbell system 400 may comprise: a barbell 50, first barbell collar 200, and second barbell collar 250. The first barbell collar 200 may comprise: a first plate 205, first weight bar 210, and second weight bar 215. The second barbell collar 250 may comprise: a second plate 255, third weight bar 260, and fourth weight bar 265.

Figure 19:
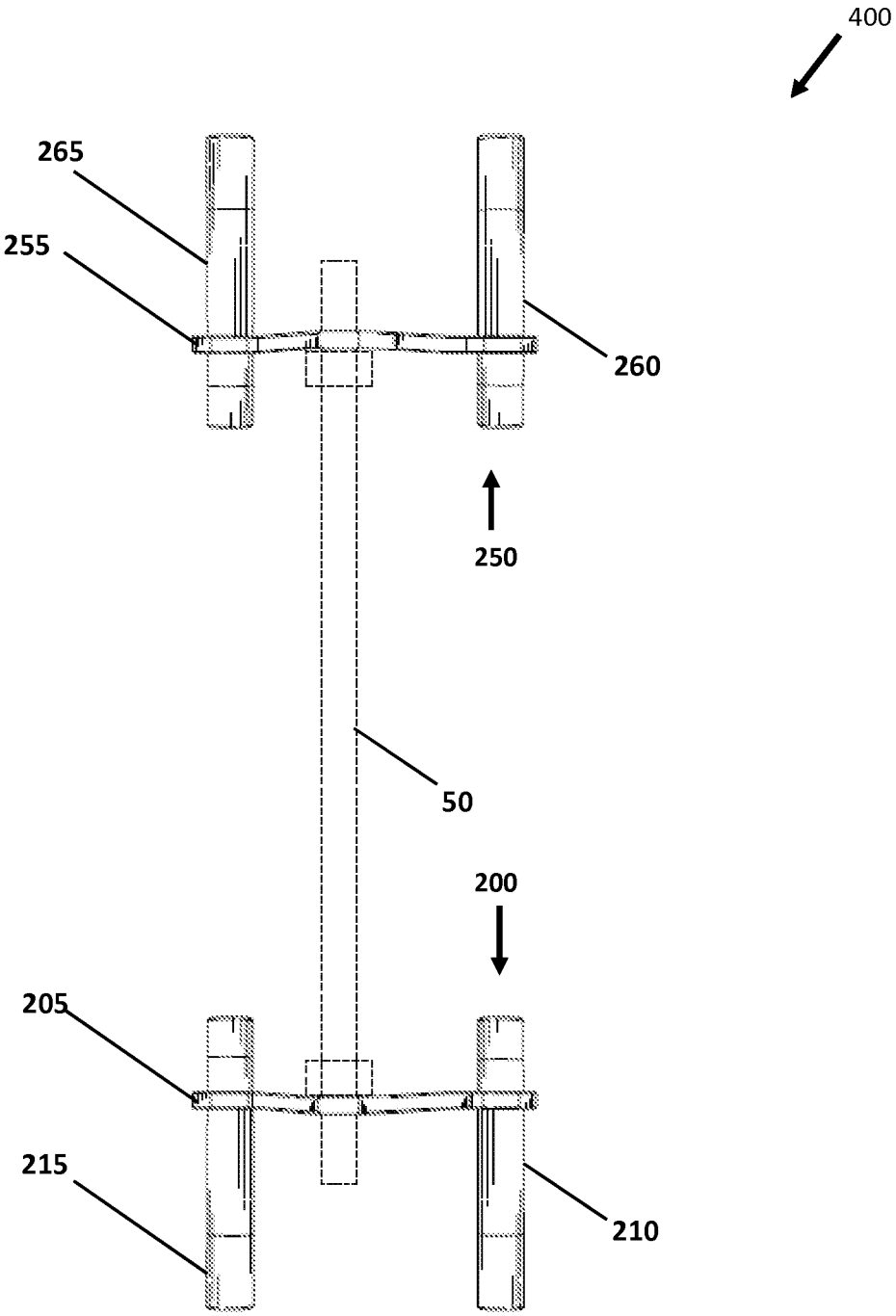
FIG. 19 is an illustration of a bottom plan view of another embodiment of the barbell system.

FIG. 19 is an illustration of a bottom plan view of another embodiment of the barbell system. As shown in FIG. 19, another embodiment of the barbell system 400 may comprise: a barbell 50, first barbell collar 200, and second barbell collar 250. The first barbell collar 200 may comprise: a first plate 205, first weight bar 210, and second weight bar 215. The second barbell collar 250 may comprise: a second plate 255, third weight bar 260, and fourth weight bar 265.

Figure 20:
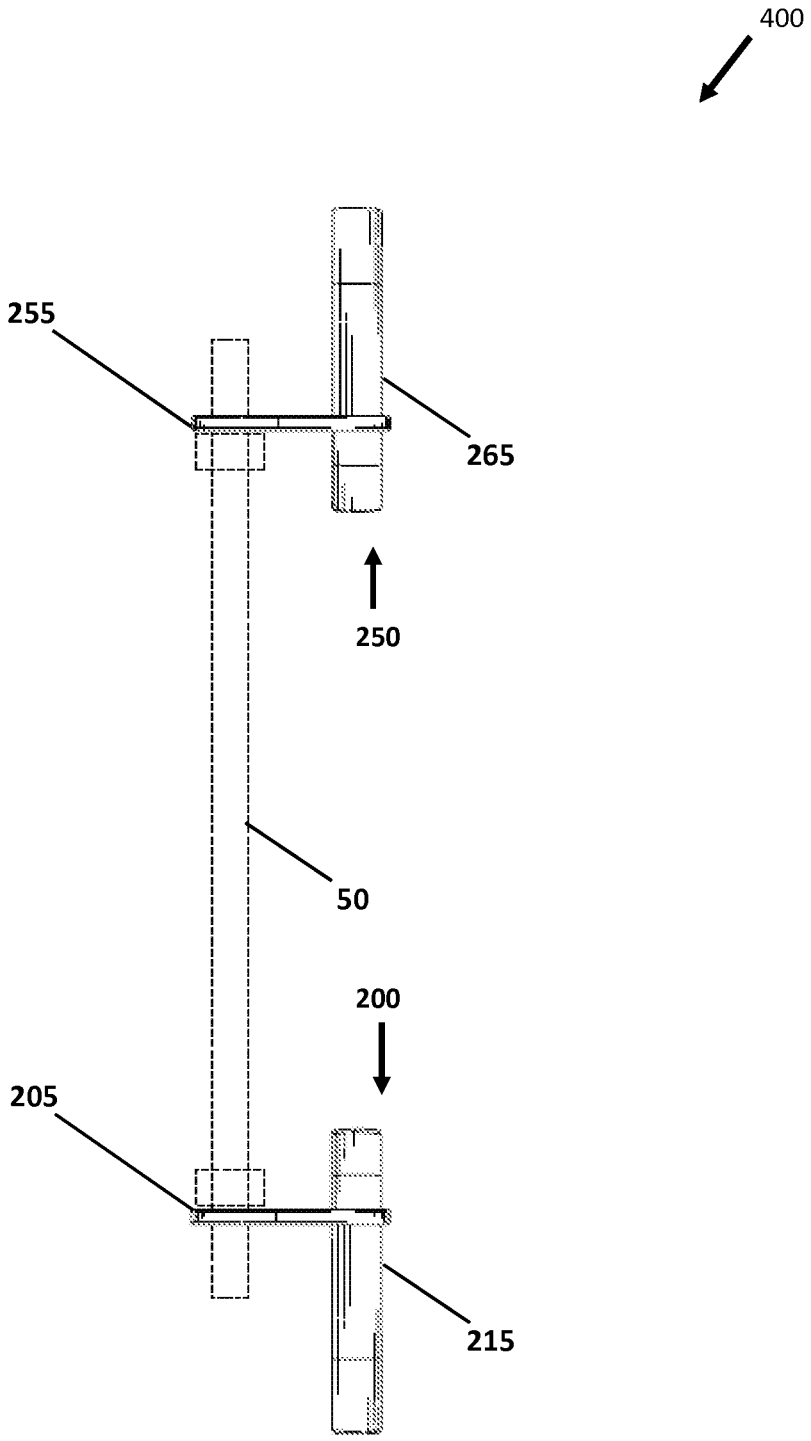
FIG. 20 is an illustration of a left side elevational view of another embodiment of the barbell system.

FIG. 20 is an illustration of a left side elevational view of another embodiment of the barbell system. As shown in FIG. 20, another embodiment of the barbell system 400 may comprise: a barbell 50, first barbell collar 200, and second barbell collar 250. The first barbell collar 200 may comprise: a first plate 205 and second weight bar 215. The second barbell collar 250 may comprise: a second plate 255 and fourth weight bar 265.

Figure 21:
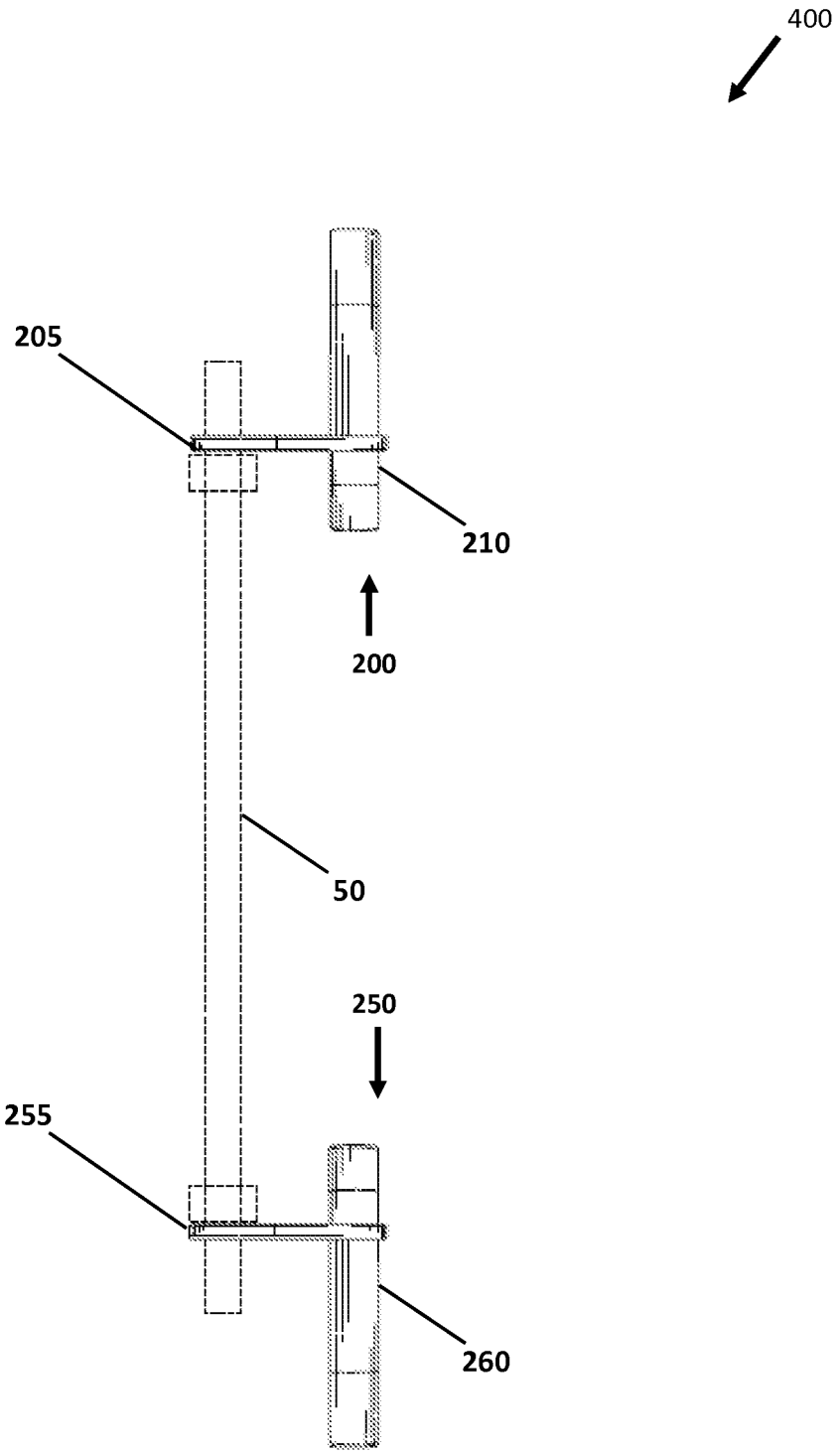
FIG. 21 is an illustration of a right side elevational view of another embodiment of the barbell system.

FIG. 21 is an illustration of a right side elevational view of another embodiment of the barbell system. As shown in FIG. 21, another embodiment of the barbell system 400 may comprise: a barbell 50, first barbell collar 200, and second barbell collar 250. The first barbell collar 200 may comprise: a first plate 205 and first weight bar 210. The second barbell collar 250 may comprise: a second plate 255 and third weight bar 260.

Figure 22:
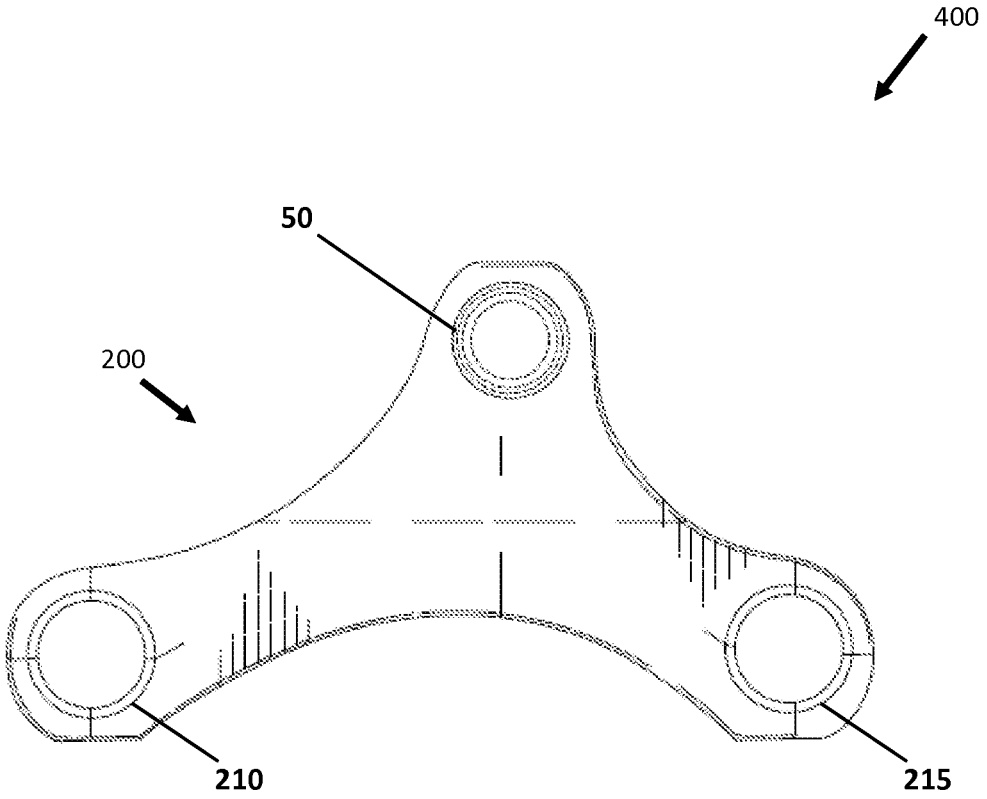
FIG. 22 is an illustration of a front elevational view of another embodiment of the barbell system.

FIG. 22 is an illustration of a front elevational view of another embodiment of the barbell system. As shown in FIG. 22, another embodiment of the barbell system 400 may comprise: a barbell 50 and first barbell collar 200. The first barbell collar 200 may comprise: a first plate 205, first weight bar 210, and second weight bar 215.

Figure 23:
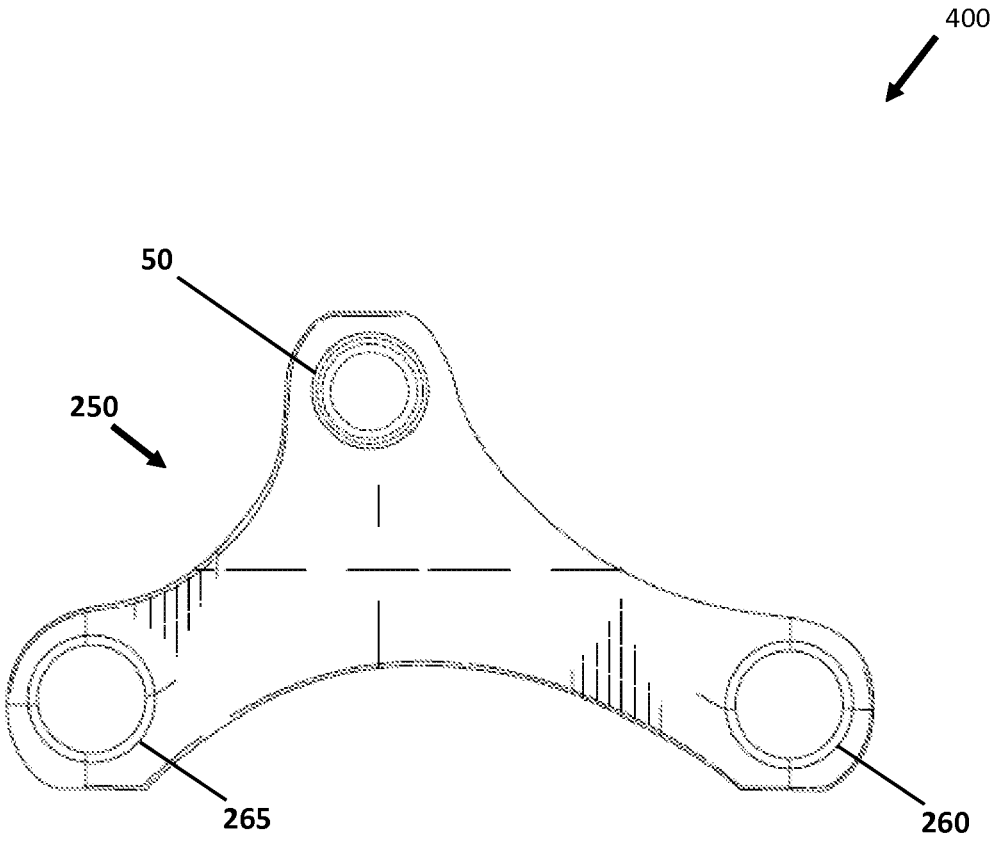
FIG. 23 is an illustration of a rear elevational view of another embodiment of the barbell system.

FIG. 23 is an illustration of a rear elevational view of another embodiment of the barbell system. As shown in FIG. 23, another embodiment of the barbell system 400 may comprise: a barbell 50 and second barbell collar 250. The second barbell collar 250 may comprise: a second plate 255, third weight bar 260, and fourth weight bar 265.

Figure 24:
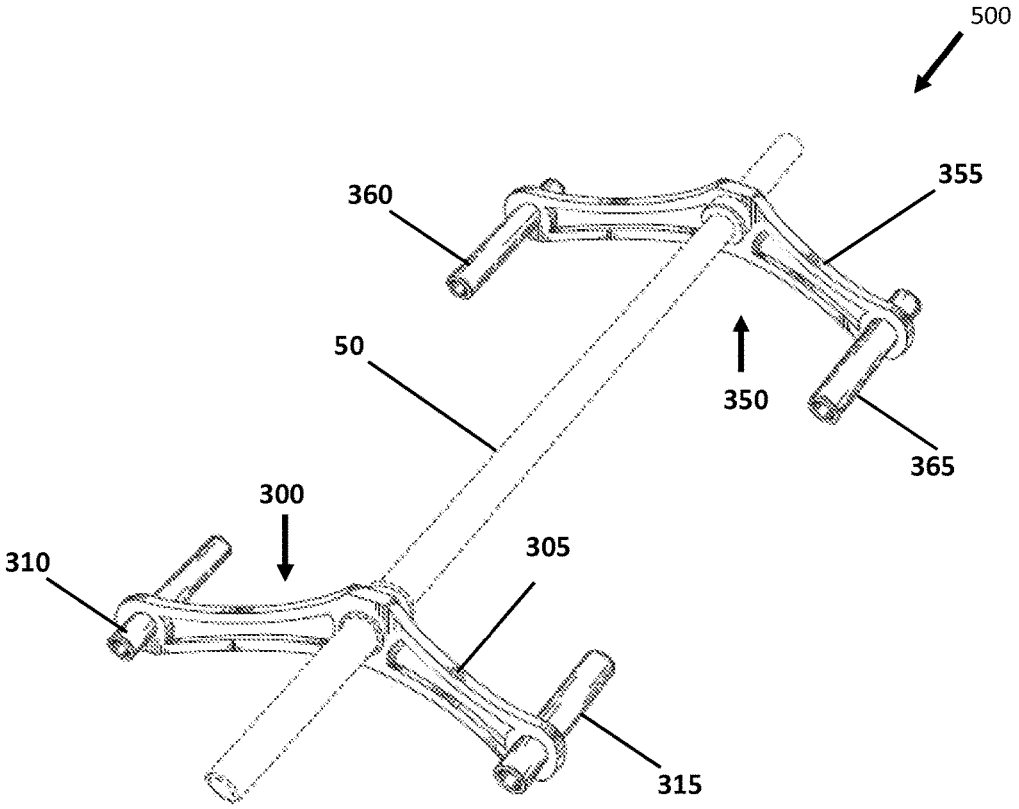
FIG. 24 is an illustration of a top perspective view of another embodiment of a barbell system.

FIG. 24 is an illustration of a top perspective view of another embodiment of a barbell system. As shown in FIG. 24, another embodiment of the barbell system 500 may comprise: a barbell 50, a first barbell collar 300, and a second barbell collar 350. The first barbell collar 300 may comprise: a first plate 305, first weight bar 310, and second weight bar 315. The second barbell collar 350 may comprise: a second plate 355, third weight bar 360, and fourth weight bar 365. In this barbell system 500, the weight bars may be extended inwards.

Figure 25:
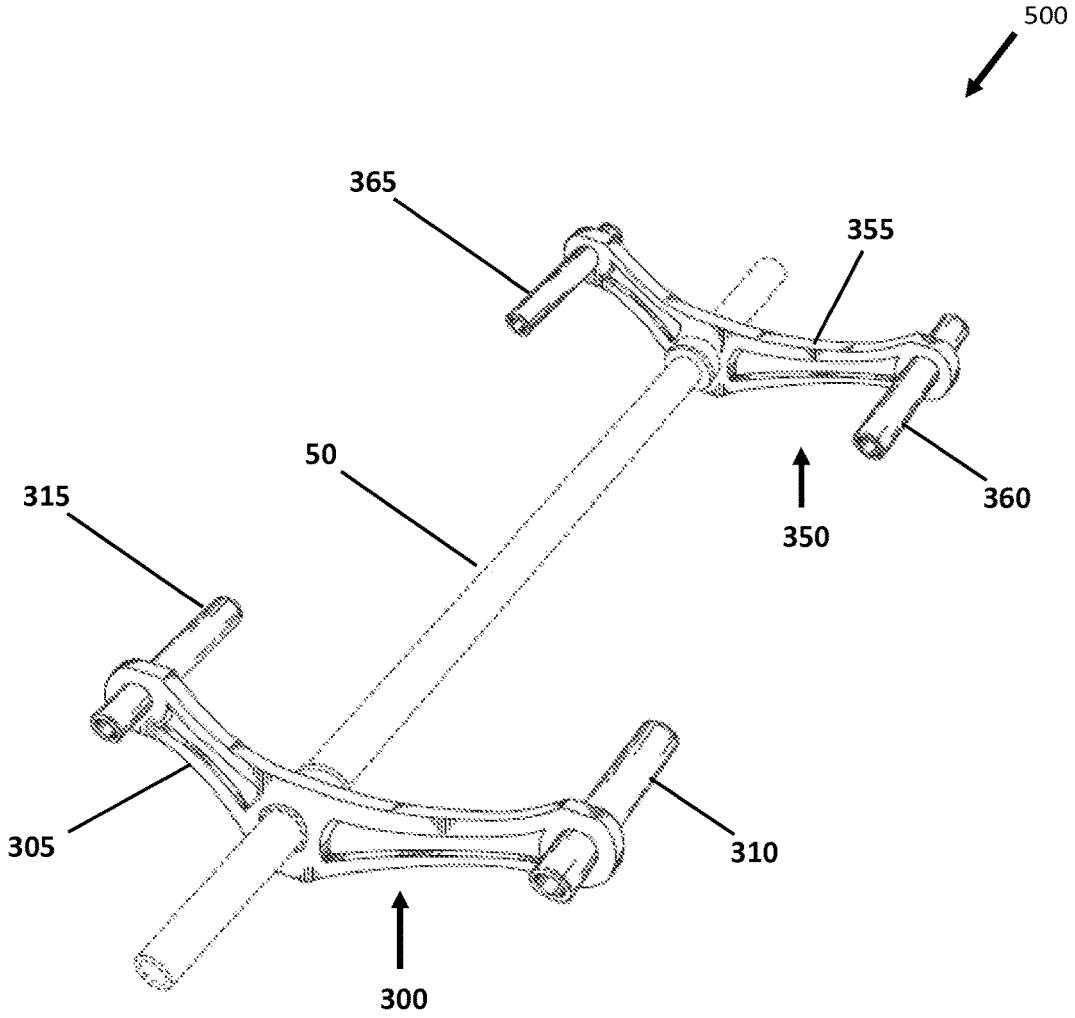
FIG. 25 is an illustration of a bottom perspective view of another embodiment of the barbell system.

FIG. 25 is an illustration of a bottom perspective view of another embodiment of the barbell system. As shown in FIG. 25, another embodiment of the barbell system 500 may comprise: a barbell 50, first barbell collar 300, and second barbell collar 350. The first barbell collar 300 may comprise: a first plate 305, first weight bar 310, and second weight bar 315. The second barbell collar 350 may comprise: a second plate 355, third weight bar 360, and fourth weight bar 365.

Figure 26:
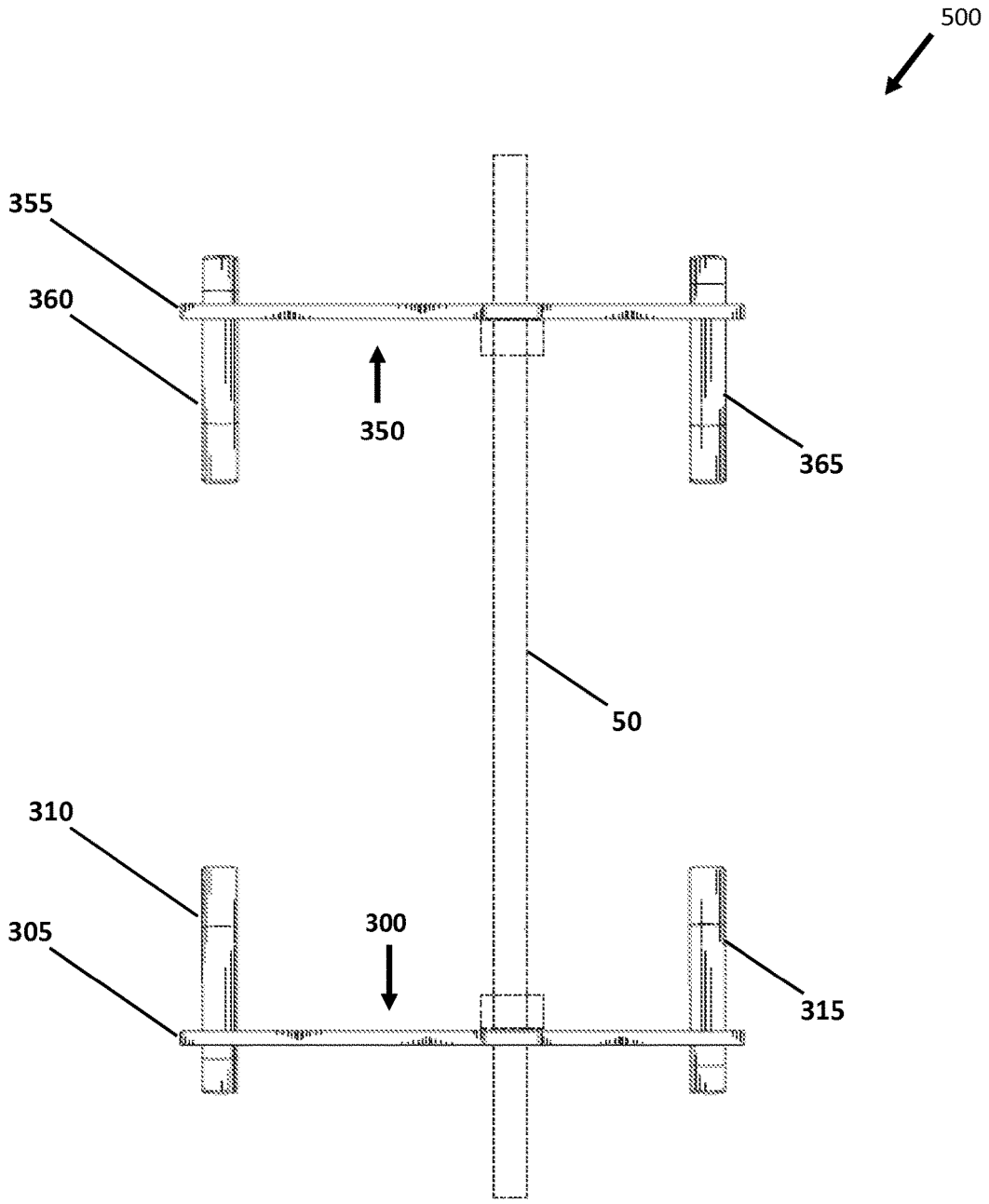
FIG. 26 is an illustration of a top plan view of another embodiment of the barbell system.

FIG. 26 is an illustration of a top plan view of another embodiment of the barbell system. As shown in FIG. 26, another embodiment of the barbell system 500 may comprise: a barbell 50, first barbell collar 300, and second barbell collar 350. The first barbell collar 300 may comprise: a first plate 305, first weight bar 310, and second weight bar 315. The second barbell collar 350 may comprise: a second plate 355, third weight bar 360, and fourth weight bar 365.

Figure 27:
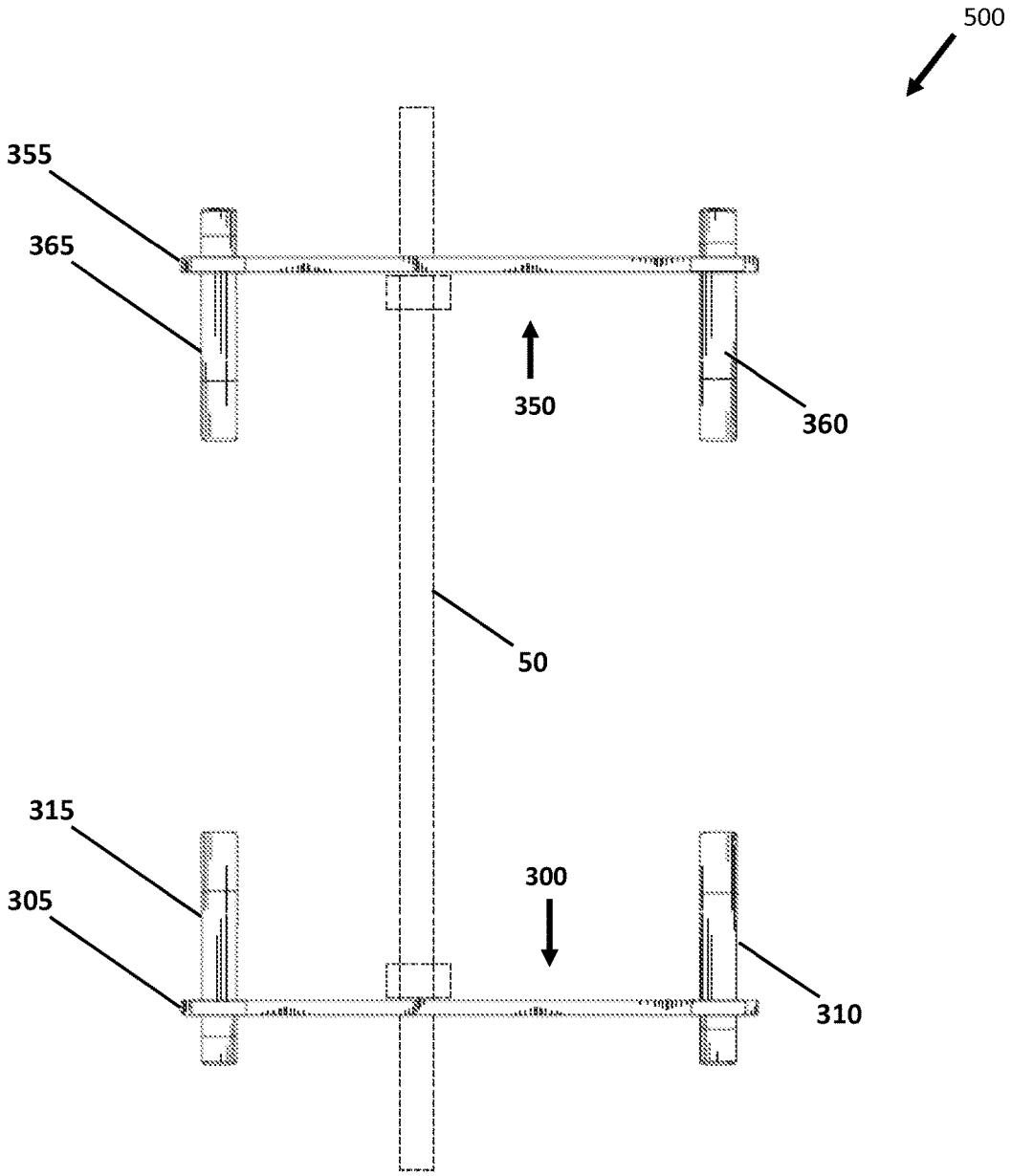
FIG. 27 is an illustration of a bottom plan view of another embodiment of the barbell system.

FIG. 27 is an illustration of a bottom plan view of another embodiment of the barbell system. As shown in FIG. 27, another embodiment of the barbell system 500 may comprise: a barbell 50, first barbell collar 300, and second barbell collar 350. The first barbell collar 300 may comprise: a first plate 305, first weight bar 310, and second weight bar 315. The second barbell collar 350 may comprise: a second plate 355, third weight bar 360, and fourth weight bar 365.

Figure 28:
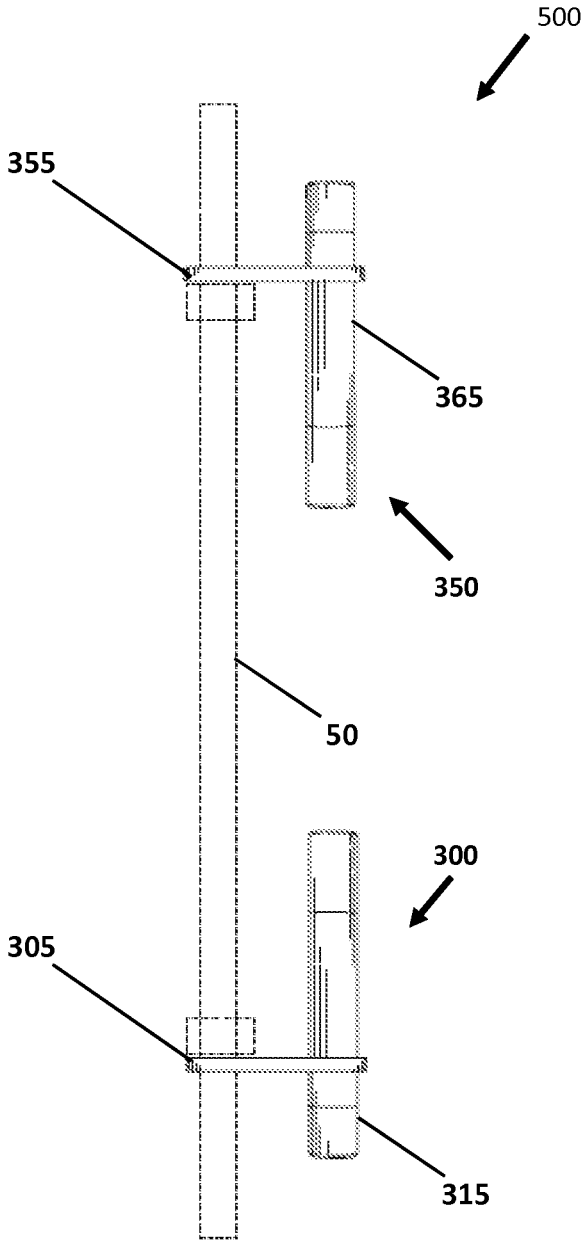
FIG. 28 is an illustration of a left side elevational view of another embodiment of the barbell system.

FIG. 28 is an illustration of a left side elevational view of another embodiment of the barbell system. As shown in FIG. 28, another embodiment of the barbell system 500 may comprise: a barbell 50, first barbell collar 300, and second barbell collar 350. The first barbell collar 300 may comprise: a first plate 305 and second weight bar 315. The second barbell collar 350 may comprise: a second plate 355 and fourth weight bar 365.

Figure 29:
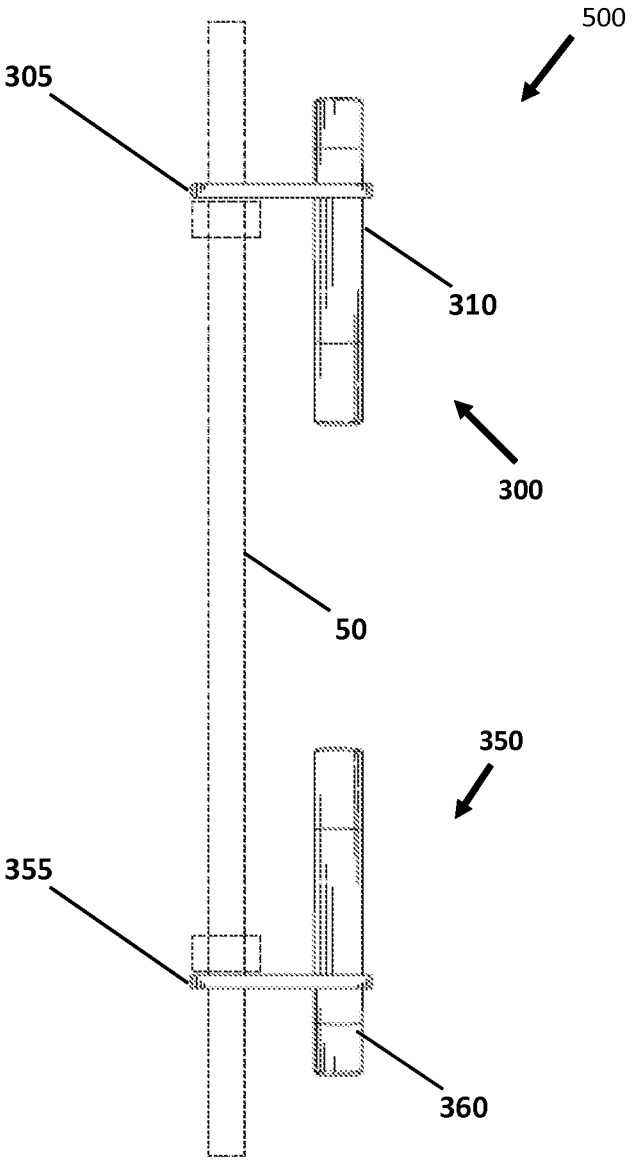
FIG. 29 is an illustration of a right side elevational view of another embodiment of the barbell system.

FIG. 29 is an illustration of a right side elevational view of another embodiment of the barbell system. As shown in FIG. 29, another embodiment of the barbell system 500 may comprise: a barbell 50, first barbell collar 300, and second barbell collar 350. The first barbell collar 300 may comprise: a first plate 305 and first weight bar 310. The second barbell collar 350 may comprise: a second plate 355 and third weight bar 360.

Figure 30:
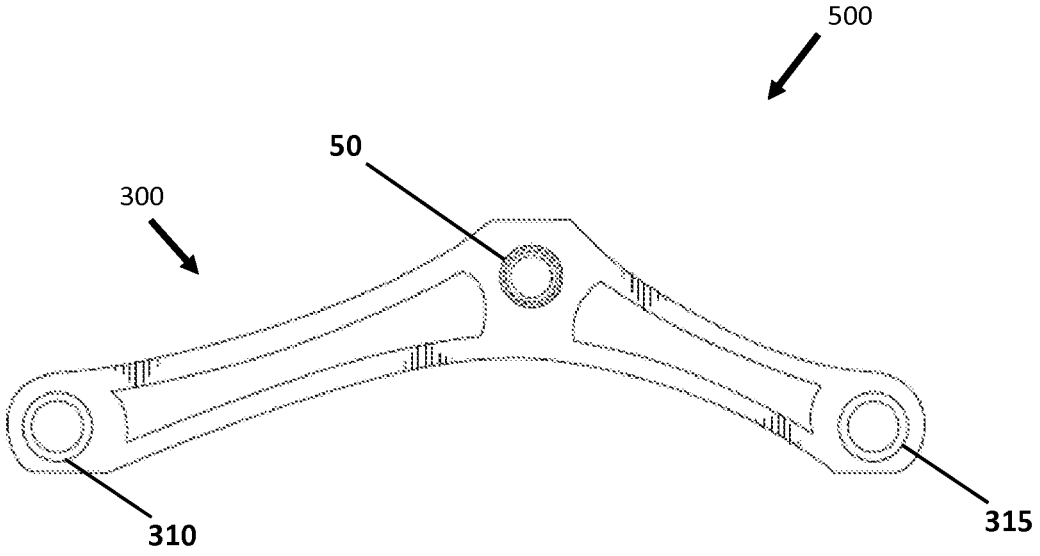
FIG. 30 is an illustration of a front elevational view of another embodiment of the barbell system.

FIG. 30 is an illustration of a front elevational view of another embodiment of the barbell system. As shown in FIG. 30, another embodiment of the barbell system 500 may comprise: a barbell 50 and first barbell collar 300. The first barbell collar 300 may comprise: a first plate 305, first weight bar 310, and second weight bar 315.

Figure 31:
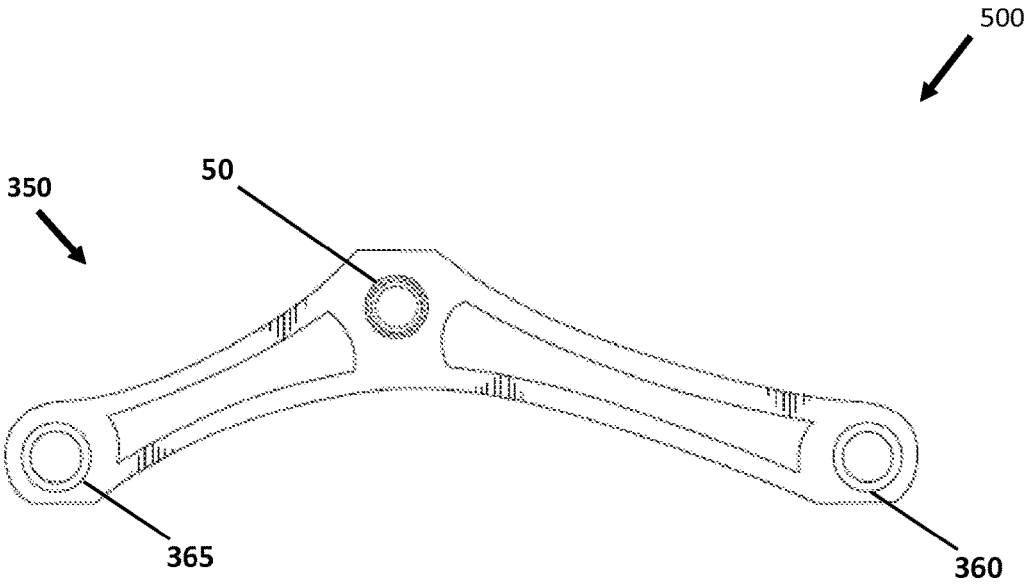
FIG. 31 is an illustration of a rear elevational view of another embodiment of the barbell system.

FIG. 31 is an illustration of a rear elevational view of another embodiment of the barbell system. As shown in FIG. 31, another embodiment of the barbell system 500 may comprise: a barbell 50 and second barbell collar 350. The second barbell collar 350 may comprise: a second plate 355, third weight bar 360, and fourth weight bar 365.

Figure 32:
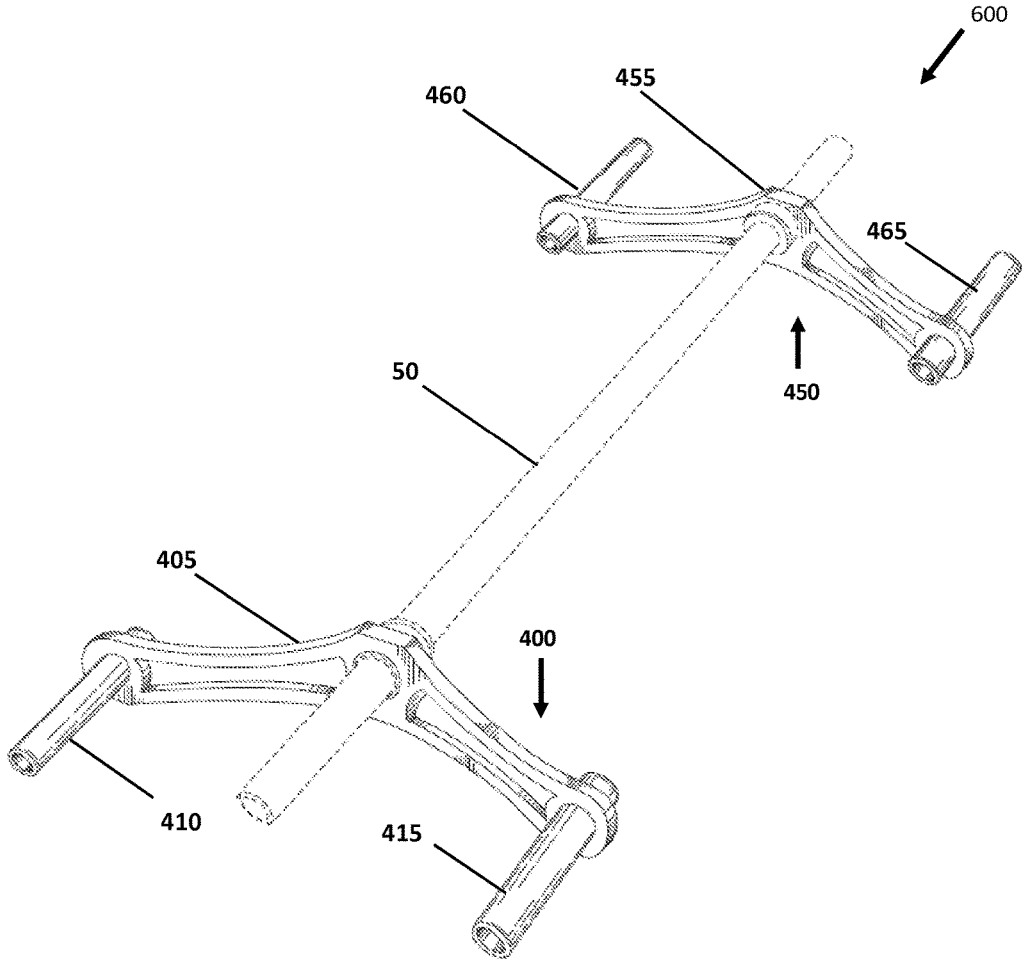
FIG. 32 is an illustration of a top perspective view of another embodiment of a barbell system.

FIG. 32 is an illustration of a top perspective view of another embodiment of a barbell system. As shown in FIG. 32, another embodiment of the barbell system 600 may comprise: a barbell 50, a first barbell collar 400, and a second barbell collar 450. The first barbell collar 400 may comprise: a first plate 405, first weight bar 410, and second weight bar 415. The second barbell collar 450 may comprise: a second plate 455, third weight bar 460, and fourth weight bar 465. Unlike the barbell system 500, this barbell system 600, the weight bars may be extended outwards.

Figure 33:
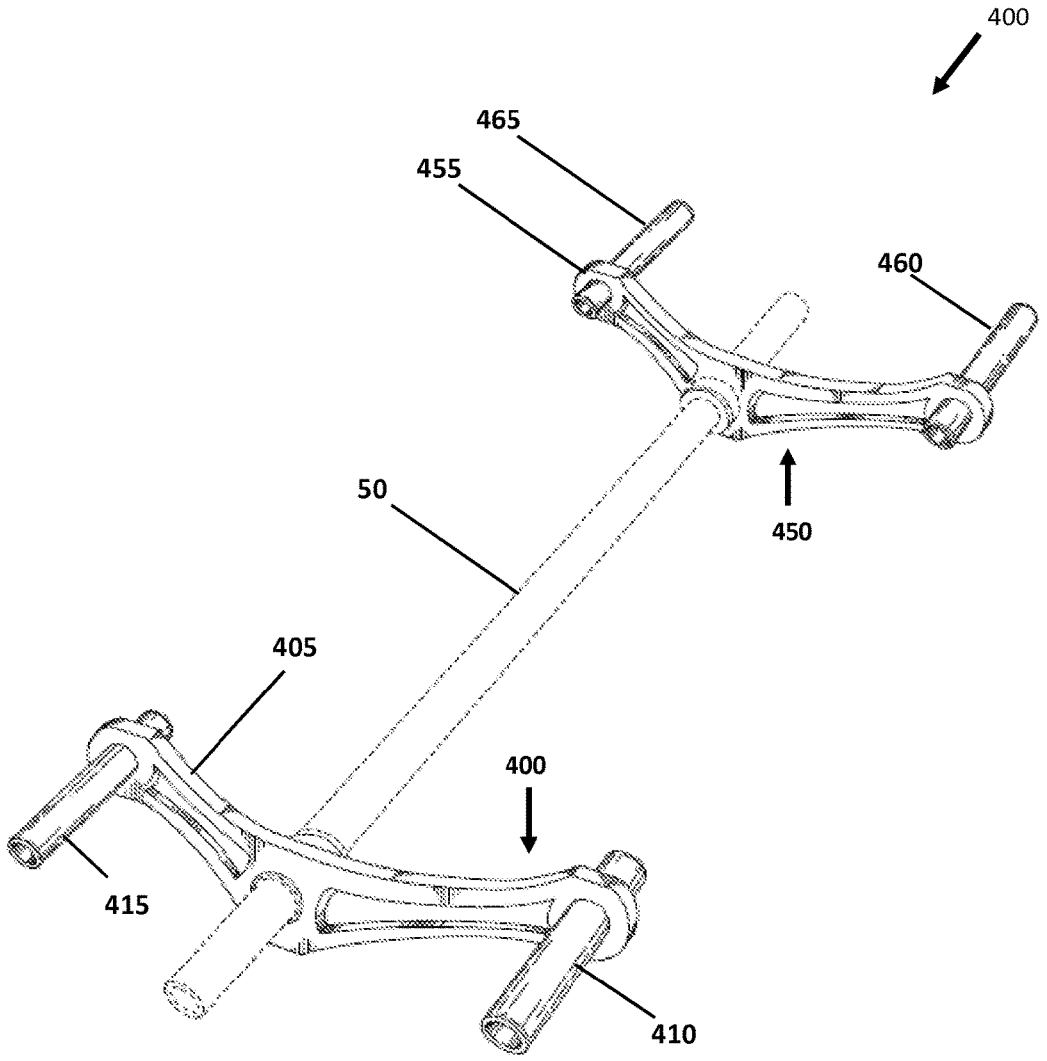
FIG. 33 is an illustration of a bottom perspective view of another embodiment of the barbell system.

FIG. 33 is an illustration of a bottom perspective view of another embodiment of the barbell system. As shown in FIG. 33, another embodiment of the barbell system 600 may comprise: a barbell 50, first barbell collar 400, and second barbell collar 450. The first barbell collar 400 may comprise: a first plate 405, first weight bar 410, and second weight bar 415. The second barbell collar 450 may comprise: a second plate 455, third weight bar 460, and fourth weight bar 465.

Figure 34:
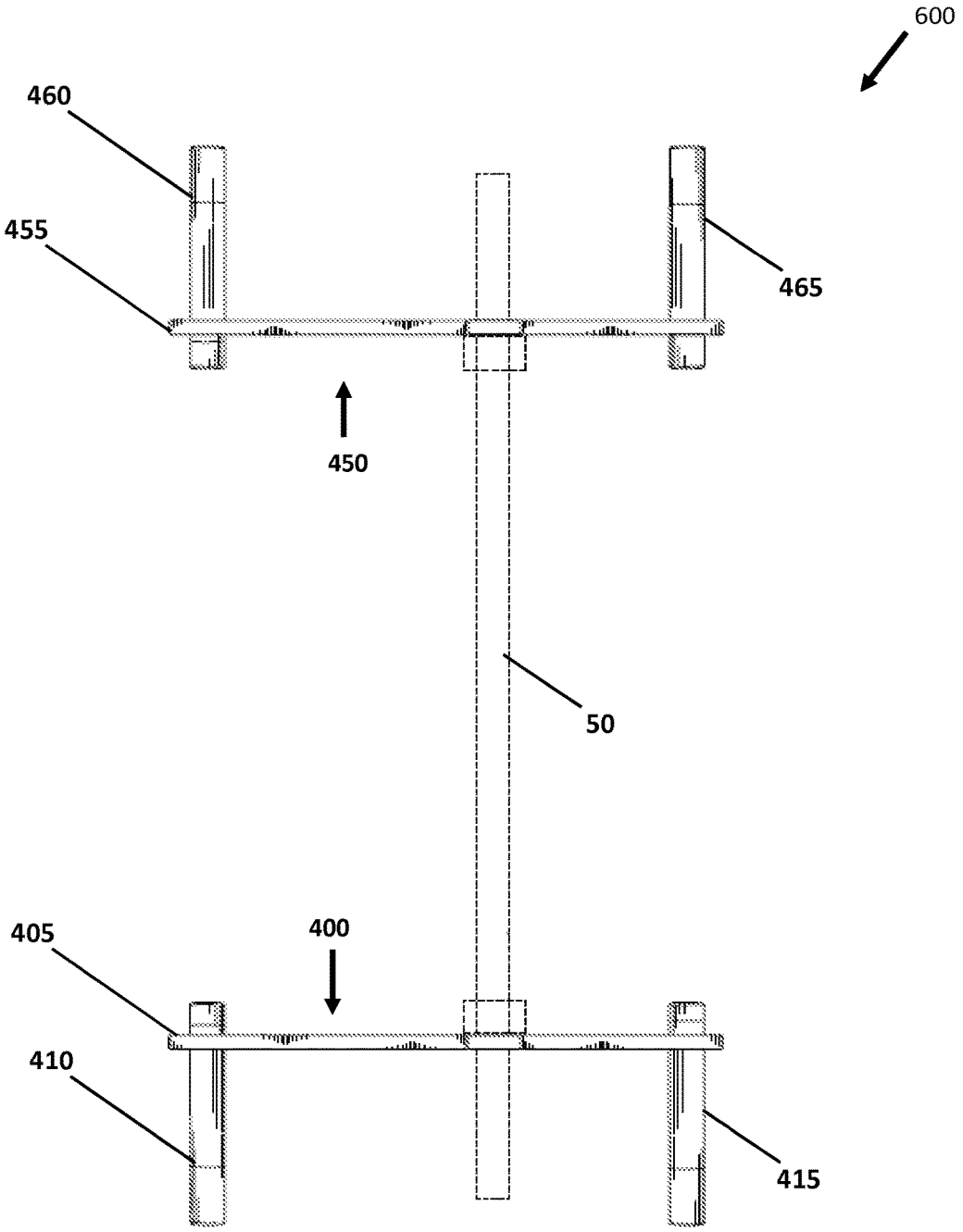
FIG. 34 is an illustration of a top plan view of another embodiment of the barbell system.

FIG. 34 is an illustration of a top plan view of another embodiment of the barbell system. As shown in FIG. 34, another embodiment of the barbell system 600 may comprise: a barbell 50, first barbell collar 400, and second barbell collar 450. The first barbell collar 400 may comprise: a first plate 405, first weight bar 410, and second weight bar 415. The second barbell collar 450 may comprise: a second plate 455, third weight bar 460, and fourth weight bar 465.

Figure 35:
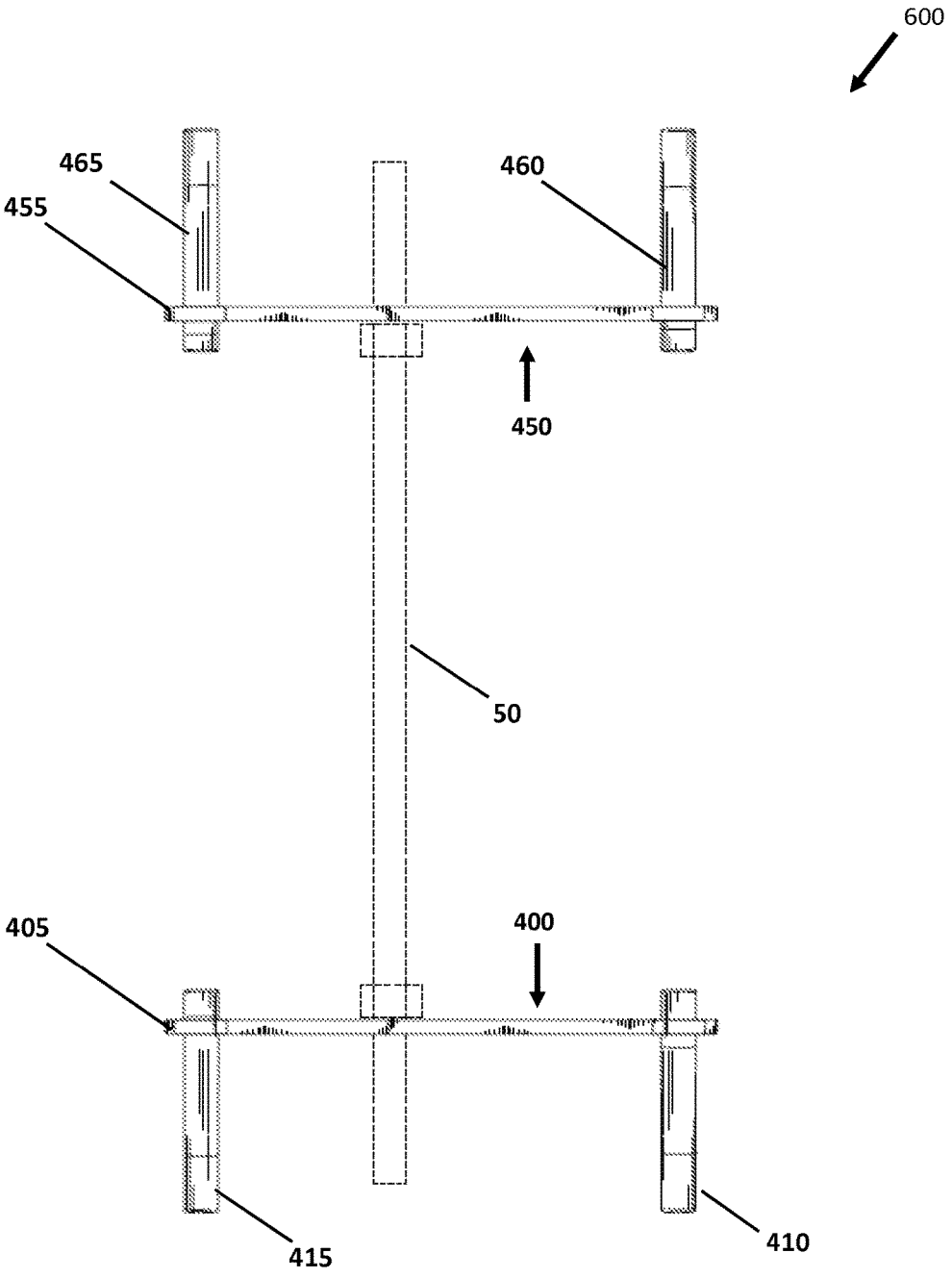
FIG. 35 is an illustration of a bottom plan view of another embodiment of the barbell system.

FIG. 35 is an illustration of a bottom plan view of another embodiment of the barbell system. As shown in FIG. 35, another embodiment of the barbell system 600 may comprise: a barbell 50, first barbell collar 400, and second barbell collar 450. The first barbell collar 400 may comprise: a first plate 405, first weight bar 410, and second weight bar 415. The second barbell collar 450 may comprise: a second plate 455, third weight bar 460, and fourth weight bar 465.

Figure 36:
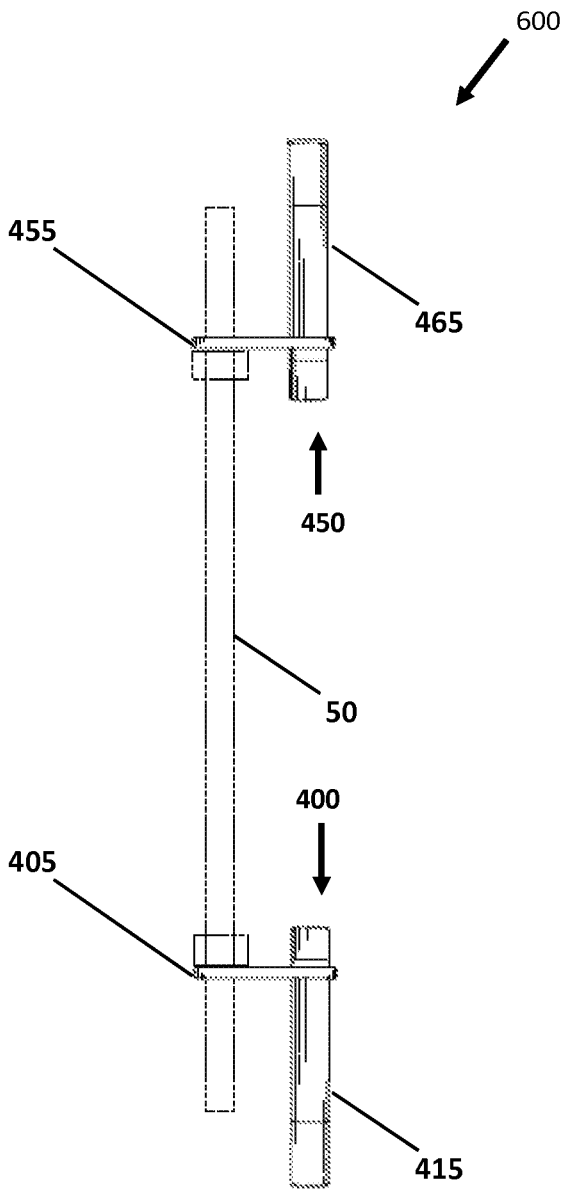
FIG. 36 is an illustration of a left side elevational view of another embodiment of the barbell system.

FIG. 36 is an illustration of a left side elevational view of another embodiment of the barbell system. As shown in FIG. 36, another embodiment of the barbell system 600 may comprise: a barbell 50, first barbell collar 400, and second barbell collar 450. The first barbell collar 400 may comprise: a first plate 405 and second weight bar 415. The second barbell collar 450 may comprise: a second plate 455 and fourth weight bar 465.

Figure 37:
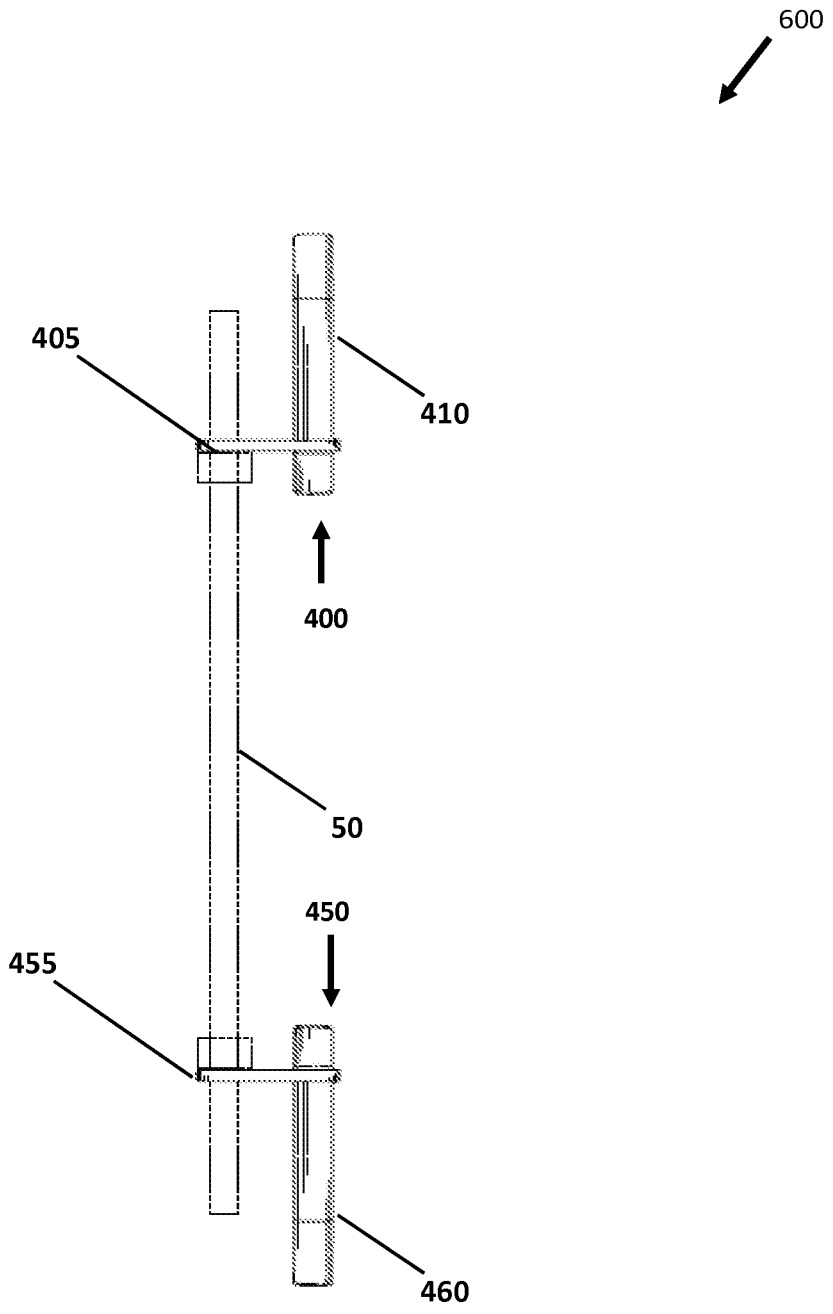
FIG. 37 is an illustration of a right side elevational view of another embodiment of the barbell system.

FIG. 37 is an illustration of a right side elevational view of another embodiment of the barbell system. As shown in FIG. 37, another embodiment of the barbell system 600 may comprise: a barbell 50, first barbell collar 400, and second barbell collar 450. The first barbell collar 400 may comprise: a first plate 405 and first weight bar 410. The second barbell collar 450 may comprise: a second plate 455 and third weight bar 460.

Figure 38:
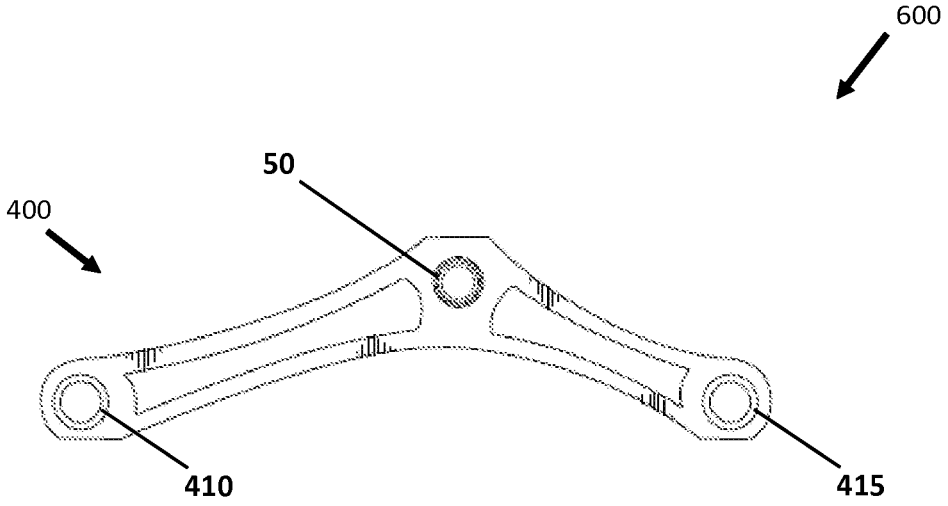
FIG. 38 is an illustration of a front elevational view of another embodiment of the barbell system.

FIG. 38 is an illustration of a front elevational view of another embodiment of the barbell system. As shown in FIG. 38, another embodiment of the barbell system 600 may comprise: a barbell 50 and first barbell collar 400. The first barbell collar 400 may comprise: a first plate 405, first weight bar 410, and second weight bar 415.

Figure 39:
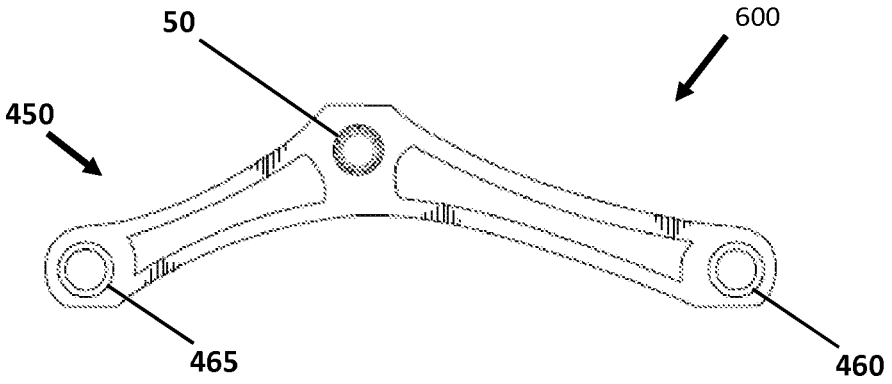
FIG. 39 is an illustration of a rear elevational view of another embodiment of the barbell system.

FIG. 39 is an illustration of a rear elevational view of another embodiment of the barbell system. As shown in FIG. 39, another embodiment of the barbell system 600 may comprise: a barbell 50 and second barbell collar 450. The second barbell collar 450 may comprise: a second plate 455, third weight bar 460, and fourth weight bar 465.

Figure 40:
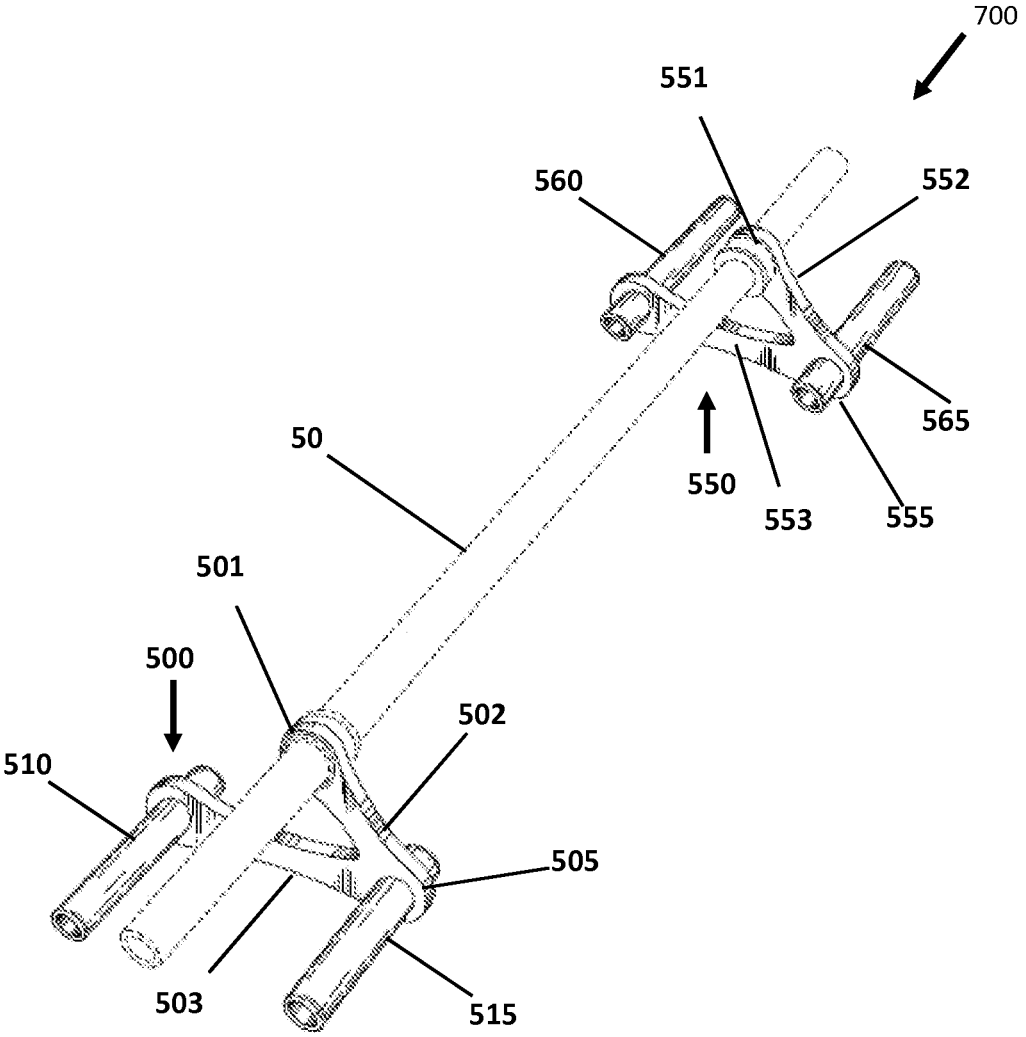
FIG. 40 is an illustration of a top perspective view of another embodiment of a barbell system.

FIG. 40 is an illustration of a top perspective view of another embodiment of a barbell system. As shown in FIG. 40, another embodiment of the barbell system 700 may comprise: a barbell 50, a first barbell collar 500, and a second barbell collar 550. The first barbell collar 500 may comprise: a first plate 505, first weight bar 510, and second weight bar 515. The second barbell collar 550 may comprise: a second plate 555, third weight bar 560, and fourth weight bar 565.

In this barbell system 700, the first plate 505 of the first barbell collar 500 and second plate 555 of the second barbell collar 550 may be substantially L-shaped. Specifically, the first hole 501 may be located at approximately near a first end of a first arm portion 502 of the first plate 505. Additionally, the second weight bar 515 may be located approximately near the second end of the first arm portion 502 of the first plate 505 and approximately near a first end of the second arm portion 503 of the first plate 505. The first weight bar 510 may be located approximately near a second end of the second arm portion 503 of the first plate 505. Although FIG. 40 shows the first weight bar 510 located approximately near the second end of the second arm portion 503 of the first plate 505, the first weight bar 510 may be located approximately near the first end of the second arm portion 503 of the first plate 505. Similarly, although FIG. 40 shows the second weight bar 515 near the first end of the second arm portion 503 of the first plate 505, the second weight bar 515 may be positioned near the second end of the second arm portion 503 of the first plate 505.

Regarding the second barbell collar 550, the second hole 551 may be located at approximately near a first end of the third arm portion 552 of the second plate 555. Additionally, the fourth weight bar 565 may be located approximately near the second end of the third arm portion 552 of the second plate 555 and approximately near a first end of the fourth arm portion 553 of the second plate 555. The third weight bar 560 may be located approximately near a second end of the fourth arm portion 553 of the second plate 555. Although FIG. 40 shows the third weight bar 560 located approximately near the second end of the fourth arm portion 553 of the second plate 555, the third weight bar 560 may be located approximately near the first end of the fourth arm portion 553 of the second plate 555. Additionally, although FIG. 40 shows the fourth weight bar 565 near the first end of the fourth arm portion 553 of the second plate 555, the fourth weight bar 565 may be positioned near the second end of the fourth arm portion 553 of the second plate 555.

Figure 41:
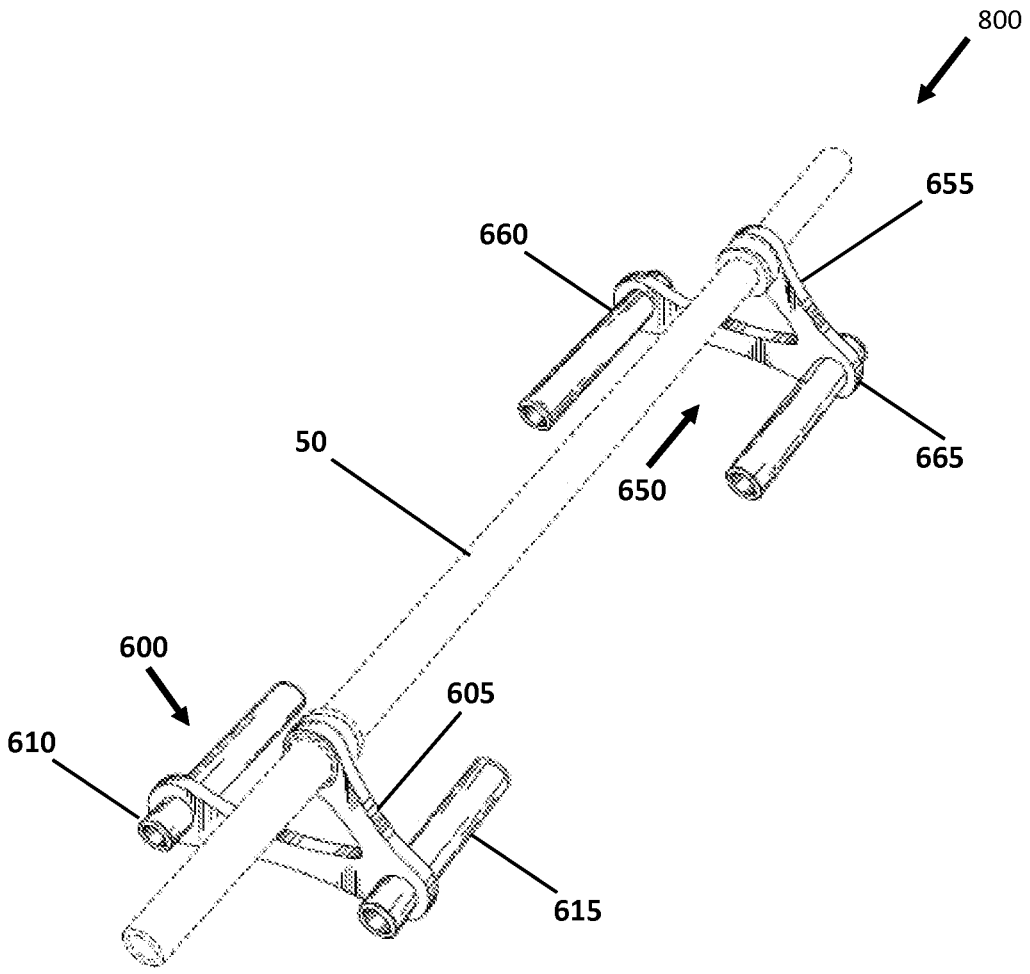
FIG. 41 is an illustration of a top perspective view of another embodiment of a barbell system.

FIG. 41 is an illustration of a top perspective view of another embodiment of a barbell system. As shown in FIG. 41, another embodiment of the barbell system 800 may comprise: a barbell 50, a first barbell collar 600, and a second barbell collar 650. The first barbell collar 600 may comprise: a first plate 605, first weight bar 610, and second weight bar 615. The second barbell collar 650 may comprise: a second plate 655, third weight bar 660, and fourth weight bar 665. Unlike the barbell system 700 shown in FIG. 40, this barbell system 800 may have the weight bars extending inwards.

Figure 42:
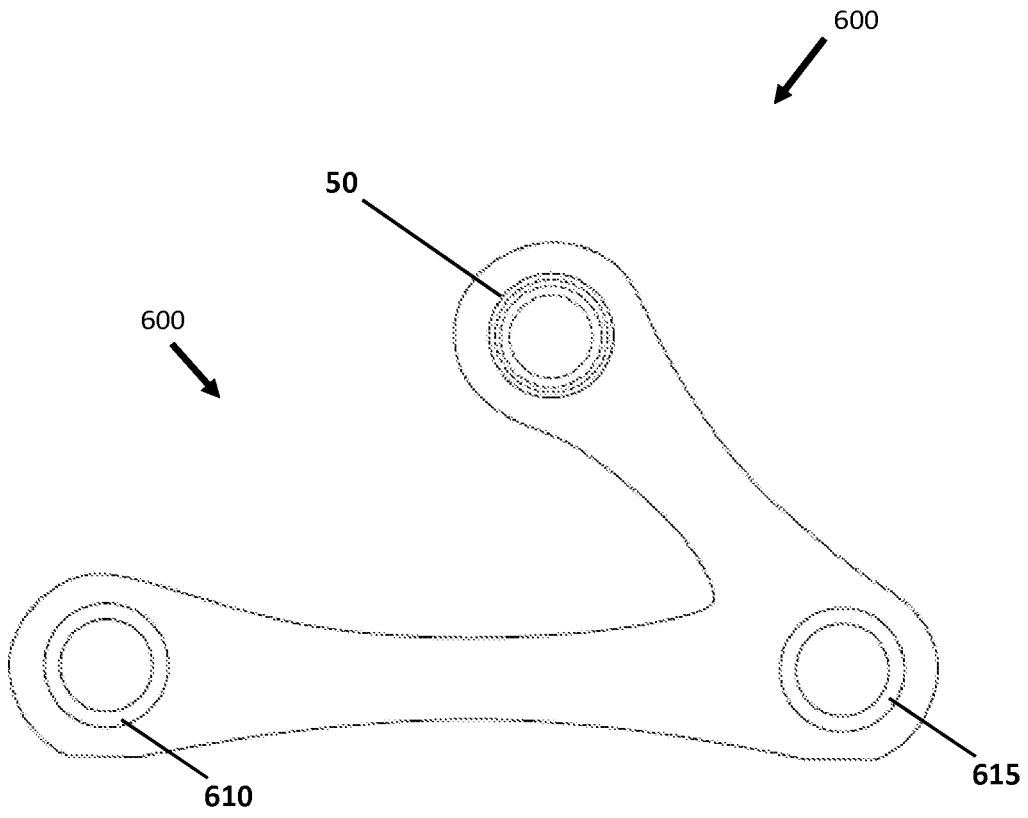
FIG. 42 is an illustration of a front view of another embodiment of a barbell system.

FIG. 42 is an illustration of a front view of another embodiment of a barbell system.

As shown in FIG. 42, another embodiment of the barbell system 800 may comprise: a barbell 50 and first barbell collar 600. The first barbell collar 600 may comprise: a first plate 605, first weight bar 610, and second weight bar 615.

Figure 43:
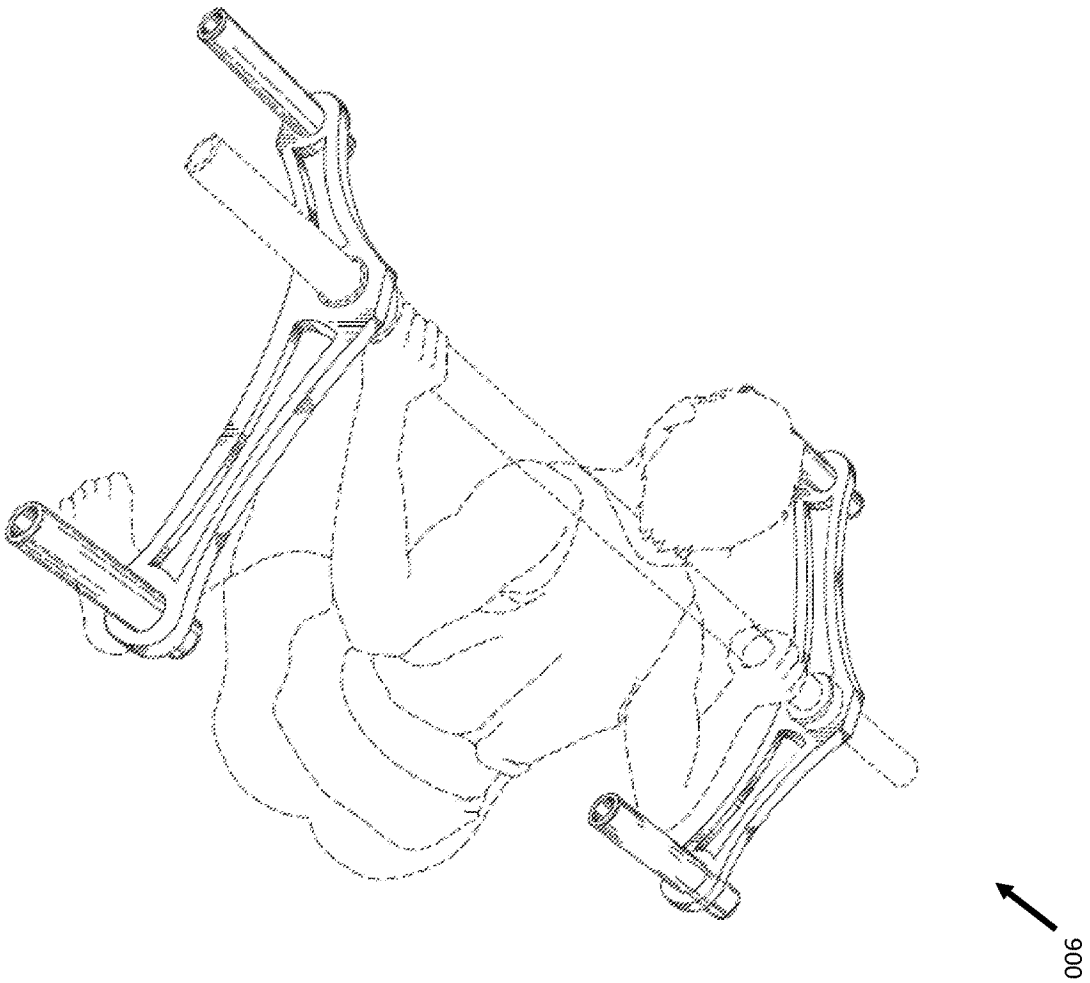
FIG. 43 is an illustration of a top perspective view of another embodiment of the barbell system, and shows a user holding a barbell.

FIG. 43 is an illustration of a top perspective view of another embodiment of the barbell system, and shows a user holding a barbell. FIG. 43 shows how a user may utilize one embodiment of the barbell system.

Figure 44:
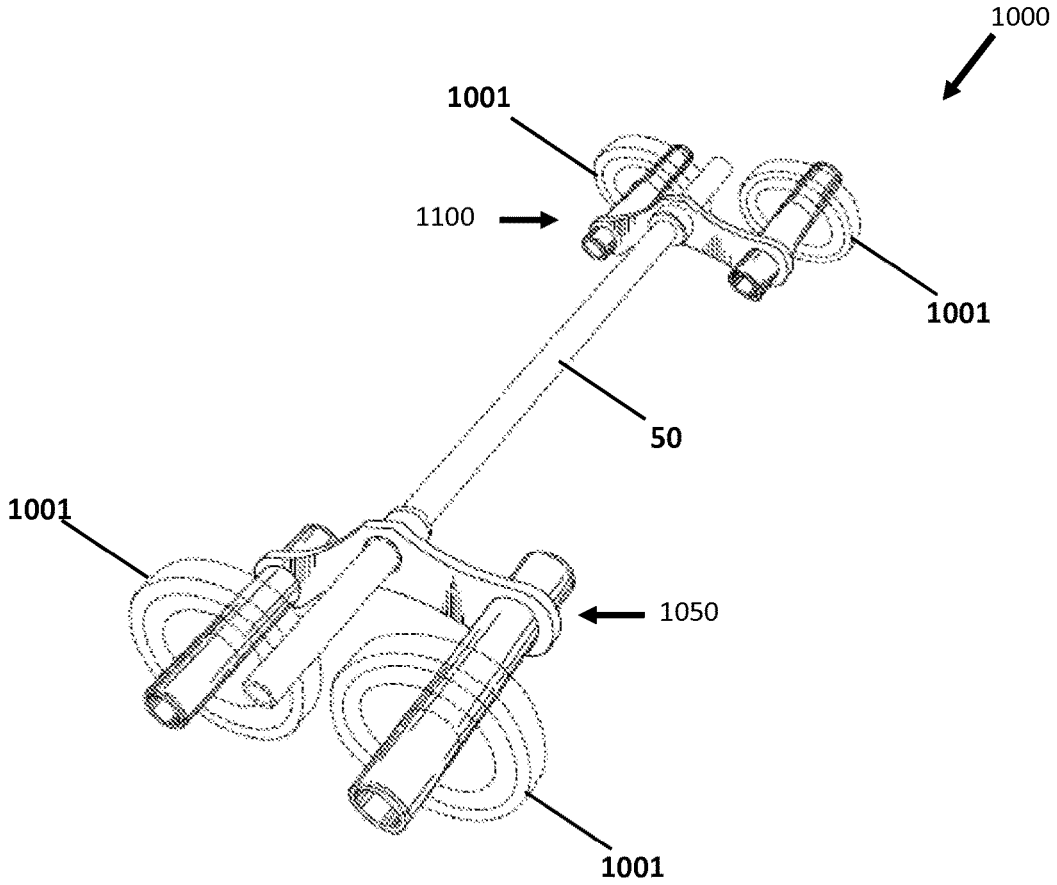
FIG. 44 is an illustration of a top perspective view of another embodiment of a barbell system and shows how disc weights may be added to one embodiment of the barbell system.

FIG. 44 is an illustration of a top perspective view of another embodiment of a barbell system and shows how disc weights may be added to one embodiment of the barbell system. As shown in FIG. 44, another embodiment of the barbell system 1000 may comprise: a barbell 50, first barbell collar 1050, second barbell collar 1100, and one or more disc weights 1001.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. This disclosure should therefore not be limited by the above described embodiment, method, and examples, but by all embodiments and methods within the scope and spirit of the disclosure as claimed.

The foregoing description of the preferred embodiment has been presented for the purposes of illustration and description. While multiple embodiments are disclosed, still other embodiments will become apparent to those skilled in the art from the above detailed description, which shows and describes illustrative embodiments. As will be realized, the embodiments are capable of modifications in various obvious aspects, all without departing from the spirit and scope. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope. It is intended that the scope not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A barbell collar, comprising:
a plate; and
at least two weight bars;
wherein said plate comprises a hole and at least two arm portions;
wherein said at least two arm portions comprise:
a first arm portion; and
a second arm portion;
wherein said first arm portion is longer than said second arm portion;
wherein said hole is configured to engage with a barbell; and
wherein each of said at least two weight bars is attached to each of said at least two arm portions of said plate; and
wherein said at least two weight bars are adapted to engage and hold one or more weights.

2. The barbell collar of claim 1, wherein said at least two arm portions comprise:
a first arm portion;
a second arm portion;
wherein said hole is located approximately near a first end of said first arm portion;
wherein said at least two weight bars comprise a first weight bar and a second weight bar;
wherein said second weight bar is located approximately near a second end of said first arm portion and approximately near a first end of said second arm portion;
wherein said first weight bar is located approximately near a second end of said second arm portion.

3. The barbell collar of claim 1, wherein said first arm portion is aligned between approximately 130 to 140 degrees from said second arm portion.

4. The barbell collar of claim 1, wherein each of said at least two weight bars is positioned approximately near an end of each of said at least two arm portions of said plate.

5. The barbell collar of claim 1, wherein said at least two weight bars are substantially perpendicular to said at least two arm portions of said plate.

6. A barbell system, comprising:
a barbell;
a first barbell collar; and
a second barbell collar;
wherein said first barbell collar comprises: a first plate and two first weight bars;
wherein said first plate comprises a first hole and two first arm portions;
wherein said first hole of said first barbell collar is configured to substantially engage with a first end of said barbell;
wherein each of said two first weight bars is attached to each of said two first arm portions of said first plate;

wherein said second barbell collar comprises: a second plate and two second weight bars;

wherein said second plate comprises a second hole and two second arm portions;

wherein said second hole of said second barbell collar is configured to substantially engage with a second end of said barbell; and wherein each of said two second weight bars is attached to each of said two second arm portions of said second plate; and wherein said two first weight bars and said two second weight bars are adapted to engage and hold said one or more weights;

wherein said two first arm portions of said first plate comprise: a first arm portion and a second arm portion;

wherein said two second arm portions of said second plate comprise: a third arm portion and a fourth arm portion;

wherein said first arm portion is longer than said second arm portion; and wherein said third arm portion is longer than said fourth arm portion.

7. The barbell collar of claim 6, wherein said first hole is located approximately near a first end of said first arm portion;

wherein said two first weight bars comprise a first weight bar and a second weight bar;

wherein said second weight bar is located approximately near a second end of said first arm portion and approximately near a first end of said second arm portion;

wherein said first weight bar is located approximately near a second end of said second arm portion;

wherein said second hole is located approximately near a first end of said third arm portion;

wherein said two second weight bars comprise a third weight bar and a fourth weight bar;

wherein said fourth weight bar is located approximately near a second end of said third arm portion and approximately near a first end of said fourth arm portion; and wherein said third weight bar is located approximately near a second end of said fourth arm portion.

8. The barbell system of claim 6, wherein said first arm portion is aligned between approximately 130 to 140 degrees from said second arm portion; and wherein said third arm portion is aligned between approximately 130 to 140 degrees from said fourth arm portion.

9. The barbell system of claim 6, wherein each of said two first weight bars is positioned approximately near an end of each of said two first arm portions of said first plate; and wherein each of said two second weight bars is positioned approximately near an end of each of said two second arm portions of said second plate.

10. The barbell system of claim 6, wherein said two first weight bars are substantially perpendicular to said two first arm portions of said first plate; and wherein said two second weight bars are substantially perpendicular to said two second arm portions of said second plate.

11. The barbell system of claim 6, further comprising a first axle bearing and a second axle bearing;

wherein said first axle bearing is positioned and substantially aligned with said first hole of said first plate;

wherein said second axle bearing is positioned and substantially aligned with said second hole of said second plate;

wherein said first axle bearing is configured to substantially engage with said first end of said barbell; and wherein said second axle bearing is configured to substantially engage with said second end of said barbell.

12. The barbell system of claim 11, wherein said first axle bearing is configured to lock on to said barbell, such that said first barbell collar does not rotate around said barbell; and wherein said second axle bearing is configured to lock on to said barbell, such that said second barbell collar does not rotate around said barbell.

13. The barbell system of claim 11, wherein said first axle bearing and said second axle bearing are configured to releasably lock on to said barbell.

14. A barbell collar, comprising:

a plate;

a first weight bar;

a second weight bar; and an axle bearing;

wherein said plate comprises: a hole, a first arm portion, and a second arm portion;

wherein said axle bearing is positioned and substantially aligned within said hole of said plate;

wherein said axle bearing is configured to substantially engage with an end of a barbell;

wherein said first arm portion is longer than said second arm portion;

wherein said first arm portion is aligned between approximately 130 to 140 degrees from said second arm portion;

wherein said first weight bar and said second weight bar are substantially tubular;

wherein said first weight bar is attached to said first arm portion of said plate and is positioned approximately near an end of said first arm portion of said plate;

wherein said second weight bar is attached to said second arm portion of said plate and is positioned approximately near an end of said second arm portion of said plate;

wherein said first weight bar is substantially perpendicular to said first arm portion of said plate;

wherein said second weight bar is substantially perpendicular to said second arm portion of said plate; and wherein said first weight bar and said second weight bar are adapted to engage and hold one or more disc weights.

15. The barbell system of claim 14, wherein said axle bearing is configured to lock on to said barbell, such that said barbell collar does not rotate around said barbell.

* * * * *